US007330169B2

(12) United States Patent
Koyama

(10) Patent No.: US 7,330,169 B2
(45) Date of Patent: Feb. 12, 2008

(54) DISPLAY DEVICE AND METHOD FOR DRIVING THE SAME

(75) Inventor: Jun Koyama, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 208 days.

(21) Appl. No.: 10/385,712

(22) Filed: Mar. 12, 2003

(65) Prior Publication Data

US 2003/0174153 A1 Sep. 18, 2003

(30) Foreign Application Priority Data

Mar. 13, 2002 (JP) ..... 2002-068001

(51) Int. Cl.
*G09G 3/32* (2006.01)

(52) U.S. Cl. ..... 345/77; 345/82; 345/690; 345/208

(58) Field of Classification Search ..... 345/60–83, 345/204, 690; 315/169.3, 169.4
See application file for complete search history.

(56) References Cited

U.S. PATENT DOCUMENTS 5,390,293 A 2/1995 Nishioka et al.
5,600,344 A 2/1997 Sono et al.
5,818,419 A 10/1998 Tajima et al.
5,990,629 A * 11/1999 Yamada et al. ..... 315/169.3
6,037,917 A * 3/2000 Kawakami ..... 345/63
6,040,812 A * 3/2000 Lewis ..... 345/89
6,088,012 A * 7/2000 Shigeta et al. ..... 345/63
6,115,017 A 9/2000 Mikami et al.
6,229,505 B1 5/2001 Fujii
6,329,973 B1 12/2001 Akimoto
6,337,677 B1 1/2002 Higashi
6,339,422 B1 * 1/2002 Kuwajima et al. ..... 345/204
6,356,028 B1 3/2002 Legagneux et al.
6,380,689 B1 * 4/2002 Okuda ..... 315/169.3

(Continued)

FOREIGN PATENT DOCUMENTS

EP 1 103 946 A2 5/2001

(Continued)

OTHER PUBLICATIONS

Washio et al., "TFT-LCDs with monolithic Multi-Drivers for High Performance Video and Low-Power Text Modes," SID 01 Digest, 2001, pp. 276-279.

*Primary Examiner*—Lun-Yi Lao
(74) *Attorney, Agent, or Firm*—Fish & Richardson P.C.

(57) ABSTRACT

In a display device using a time gradation method, power consumption at a time when multigradation display is unnecessary is reduced. In a second display mode in which the number of gradations is set to two as compared with a first display mode of multigradation, writing of a digital video signal of a lower order bit into a memory is eliminated by a memory controller of a signal control circuit included in the display device. In addition, readout of the digital video signal of the lower order bit from the memory is eliminated. The amount of information of a digital video signal inputted to a source signal line drive circuit is reduced. In accordance with such operation, a display controller sets a display period for conducting display to be long. When the gradation is reduced, a frame period can be also set to be longer than the first display mode.

26 Claims, 16 Drawing Sheets

U.S. PATENT DOCUMENTS

| | | | | |
|---|---|---|---|---|
| 6,396,508 | B1 | 5/2002 | Noecker | |
| 6,417,824 | B1 | 7/2002 | Tokunaga et al. | |
| 6,552,736 | B2 | 4/2003 | Honda et al. | |
| 6,617,785 | B2 | 9/2003 | Shibata et al. | |
| 6,646,625 | B1 * | 11/2003 | Shigeta et al. | 345/63 |
| 6,646,654 | B2 * | 11/2003 | Takagi | 345/690 |
| 6,670,773 | B2 * | 12/2003 | Nakamura et al. | 315/169.3 |
| 6,678,834 | B1 | 1/2004 | Aihara et al. | |
| 6,693,385 | B2 | 2/2004 | Koyama | |
| 6,693,614 | B2 * | 2/2004 | Kamiya et al. | 345/89 |
| 6,738,036 | B2 | 5/2004 | Janssen et al. | |
| 6,806,859 | B1 | 10/2004 | Kanoh et al. | |
| 6,847,339 | B2 | 1/2005 | Haginoya | |
| 6,867,761 | B2 | 3/2005 | Matsueda | |
| 2001/0005196 | A1 | 6/2001 | Ishii | |
| 2001/0011989 | A1 | 8/2001 | Hayashi | |
| 2001/0033252 | A1 | 10/2001 | Yamazaki et al. | |
| 2002/0000969 | A1 | 1/2002 | Ozawa | |
| 2002/0047568 | A1 | 4/2002 | Koyama | |
| 2002/0047852 | A1 | 4/2002 | Inukai et al. | |
| 2002/0154151 | A1 | 10/2002 | Koyama | |
| 2003/0011626 | A1 | 1/2003 | Tanabe et al. | |
| 2003/0063077 | A1 | 4/2003 | Koyama | |
| 2003/0174153 | A1 | 9/2003 | Koyama | |
| 2004/0095364 | A1 * | 5/2004 | Koyama et al. | 345/690 |

FOREIGN PATENT DOCUMENTS

| | | |
|---|---|---|
| EP | 1 184 833 A2 | 3/2002 |
| GB | 2177829 A | 1/1987 |
| JP | 06-118928 | 4/1994 |
| JP | 08-069690 | 3/1996 |
| JP | 09-274472 | 10/1997 |
| JP | 11-133921 | 5/1999 |
| JP | 2001-005421 | 1/2001 |
| JP | 2001-343933 | 12/2001 |
| JP | 2002-108285 | 4/2002 |
| JP | 2002-149113 | 5/2002 |
| JP | 2002-149119 | 5/2002 |
| TW | 78107405 | 1/1991 |

* cited by examiner

FIG. 14A
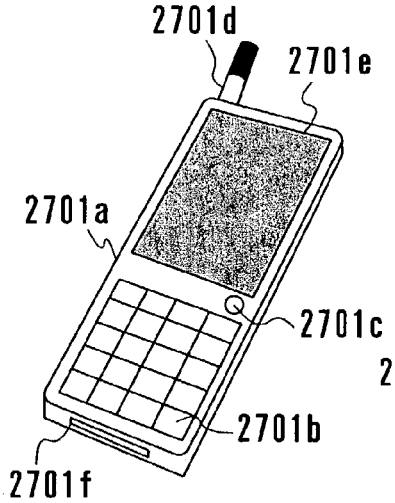
FIG. 14B
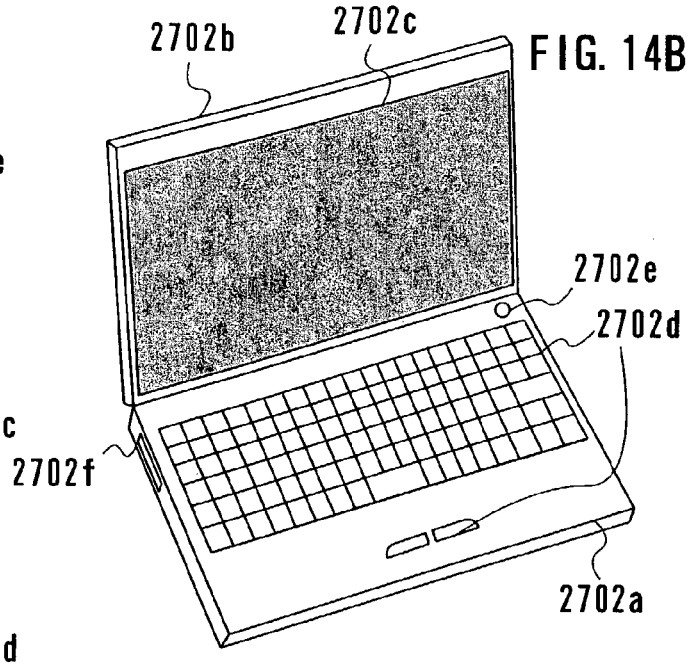
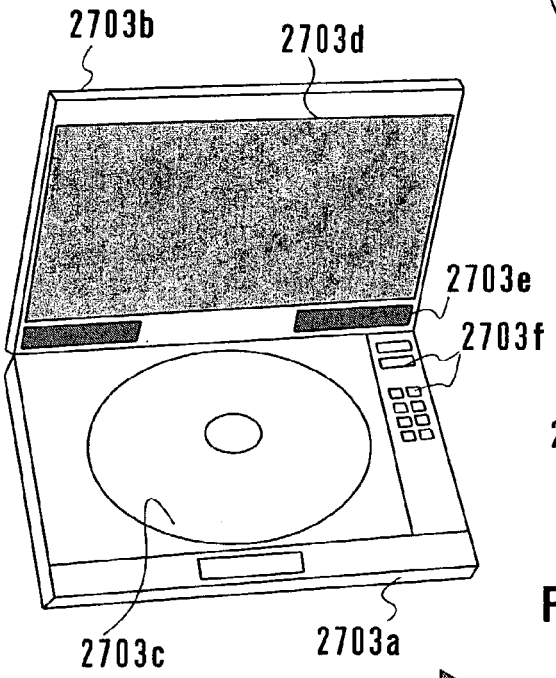
FIG. 14C
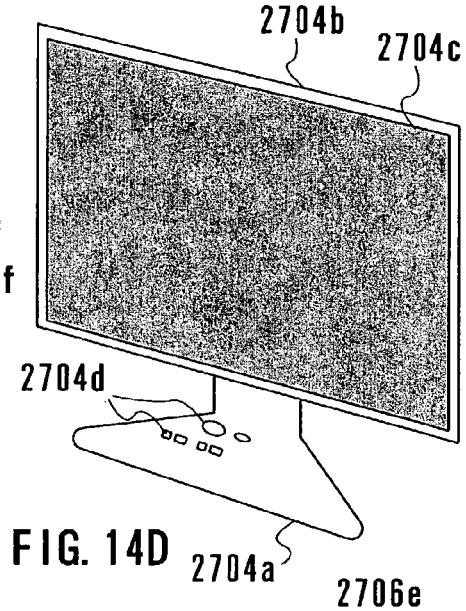
FIG. 14D
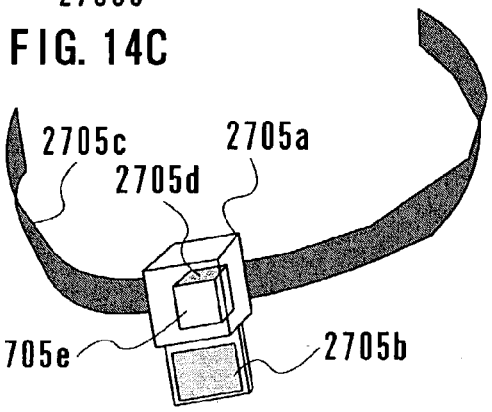
FIG. 14E
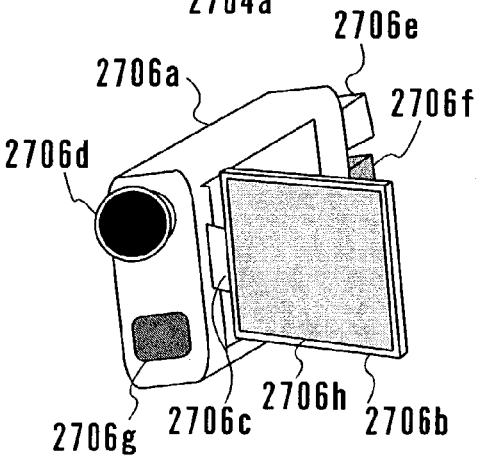
FIG. 14F

DISPLAY DEVICE AND METHOD FOR DRIVING THE SAME

BACKGROUND OF THE INVENTION

1. Field of the Invention

The present invention relates to a display device for displaying an image by inputting a digital video signal. In particular, the present invention relates to a display device having light emitting elements. Further, the present invention relates to an electronic appliance that uses the display device.

2. Description of the Related Art

A display device having a light emitting element disposed in each pixel which performs display of an image by controlling light emitted from the light emitting elements is explained below.

The explanation throughout this specification uses elements (OLED elements) having a structure in which an organic compound layer for emitting light when an electric field is generated is sandwiched between an anode and a cathode, for the light emitting elements, but the present invention is not limited to this structure.

Further, the explanation within this specification uses elements that utilize light emitted when making a transition from singlet excitons to a base state (fluorescence), and those that utilize light emitted when making a transition from triplet excitons to a base state (phosphorescence).

Layers such as hole injecting layers, hole transporting layers, light emitting layers, electron transporting layers, electron injecting layers can be given as organic compound layers. Light emitting elements basically are shown by structures in which an anode, a light emitting layer, and a cathode overlap in this order. In addition, structures such as a structure in which an anode, a hole injecting layer, a light emitting layer, an electron injecting layer, and a cathode are overlapped in this order, and one in which an anode, a hole injecting layer, a hole transporting layer, a light emitting layer, an electron transporting layer, an electron injecting layer, and a cathode are overlapped in this order may also be used.

A display device is constituted by a display and peripheral circuits for inputting signals to the display.

The structure of the display is shown in a block diagram of FIG. 6.

In FIG. 6, the display 100 is constituted by a source signal line driver circuit 1107, a gate signal line driver circuit 1108, and a pixel portion 1109. The pixel portion has pixels disposed in a matrix shape.

Thin film transistors (hereafter referred to as TFTs) are arranged in each pixel. A method of placing two TFTs in each pixel and controlling light emitted from the light emitting element of each pixel is explained.

FIG. 7 shows a structure of a pixel portion of a display device.

Source signal lines S1 to Sx, gate signal lines G1 to Gy, and electric power source supply lines V1 to Vx are arranged in a pixel portion 700, and x columns and y rows (where x and y are natural numbers) of pixels are also placed in the pixel portion. Each pixel 700 has a switching TFT 701, a driver TFT 702, a storage capacitor 703, and a light emitting element 704.

The pixel is constituted by one source signal line S of the source signal lines S1 to Sx, one gate signal line G of the gate signal lines G1 to Gy, one electric power source supply line V of the electric power source supply lines V1 to Vx, the switching TFT 701, the driver TFT 702, the storage capacitor 703, and the light emitting element 704.

A gate electrode of the switching TFT 701 is connected to the gate signal line G, and either a source region or a drain region of the switching TFT 701 is connected to the source signal line S, while the other is connected to a gate electrode of the driver TFT 702 and to one electrode of the storage capacitor 703. Either a source region or a drain region of the driver TFT 702 is connected to the electric power source supply line V, while the other is connected to an anode or a cathode of the light emitting element 704. The electric power source supply line V is connected to one of the two electrodes of the storage capacitor 703, namely the electrode on a side to which the driver TFT 702 and the switching TFT 701 are not connected.

The anode of the light emitting element 704 is referred to as a pixel electrode, and the cathode of the light emitting element 704 is referred to as an opposing electrode, within this specification for cases in which the source region or the drain region of the driver TFT 702 is connected to the anode of the light emitting element 704. On the other hand, if the source region or the drain region of the driver TFT 702 is connected to the cathode of the light emitting element 704, then the cathode of the light emitting element 704 is referred to as the pixel electrode, and the anode of the light emitting element 704 is referred to as the opposing electrode.

Further, an electric potential imparted to the electric power source supply line V is referred to as an electric power source electric potential, and an electric potential imparted to the opposing electrode is referred to as an opposing electric potential.

The switching TFT 701 and the driver TFT 702 may be either p-channel TFTs or n-channel TFTs. However, it is preferable that the driver TFT 702 is a p-channel TFT, and that the switching TFT 701 is an n-channel TFT for cases in which the pixel electrode of the light emitting element 704 is the anode. Conversely, it is preferable that the driver TFT 702 is an n-channel TFT, and that the switching TFT 701 is a p-channel TFT if the pixel electrode is the cathode.

Operations during display of an image with the aforementioned pixel structure are explained below.

A signal is input to the gate signal line G, and the electric potential of the gate electrode of the switching TFT 701 changes, then a gate voltage is changed. The signal is input to the gate electrode of the driver TFT 702 by the source signal line S, via the source and drain of the switching TFT 701 which thus has been placed in a conductive state. Further, the signal is stored in the storage capacitor 703. The gate voltage of the driver TFT 702 changes in accordance with the signal input to the gate electrode of the driver TFT 702, then the source and drain are placed in a conductive state. The electric potential of the electric power source supply line V is imparted to the pixel electrode of the light emitting element 704 through the driver TFT 702. The light emitting element 704 thus emits light.

A method of expressing gradations with pixels having such a structure is explained. Gradation expression methods can be roughly divided into an analog method and a digital method. The digital method has advantages of being good at variation of TFTs. A digital gradation expression method is focused upon here. A time gradation method can be given as the digital gradation expression method. A time gradation driving method is explained in detail below.

The time gradation driving method is a method of expressing gradations by controlling the period that each pixel of a display device emits light. If a period for displaying one image is taken as one frame period, then one frame period is divided into a plurality of subframe periods.

Turn on and turn off, namely whether or not the light emitting element of each pixel is made to emit light or to not emit light, is performed for each subframe period. The period during which the light emitting element emits light in one frame period is controlled, and a gradation for each pixel is expressed.

The time gradation driving method is explained in detail using timing charts of FIG. 5. Note that an example of expressing gradations using a 4-bit digital image signal is shown in FIG. 5. Note also that FIG. 7 may be referred to regarding the structure of the pixel portion and the structure of the pixels, respectively. In accordance with an external electric power source (not shown in the figures), the opposing electric potential can be switched over between an electric potential on the same order as the electric potential of the electric power source supply lines V1 to Vx (electric power source electric potential), and an electric potential difference of the electric power source supply lines V1 to Vx on an order sufficient to make the light emitting element 704 emit light.

One frame period F is divided into a plurality of subframe periods SF1 to SF4. The gate signal line. G1 is selected first in the first subframe period SF1, and a digital image signal is input from the source signal lines S1 to Sx to each of the pixels having the switching TFTs 701 with gate electrodes connected to the gate signal line G1. The driver TFT 702 of each pixel is placed in an ON state or an OFF state by the input digital image signal.

The term "ON state" for a TFT in this specification indicates that the TFT is in a state in which there is a state of conduction between the source and the drain in accordance with a gate voltage. Further, the term "OFF state" for a TFT indicates that there is a non-conductive state between the source and the drain in accordance with the gate voltage.

The opposing electric potential of the light emitting elements 704 is set nearly equal to the electric potential of the electric power source supply lines V1 to Vx (electric power source electric potential) at this point, and therefore the light emitting elements 704 do not emit light even in pixels having their driver TFT 702 in an ON state. The aforementioned operations are repeated for all of the gate signal lines G1 to Gy, and a write-in period Ta1 is completed. Note that a period for write-in during the first subframe period SF1 is called Ta1. In general, a write-in period of a j-th sub-frame period SFj (where j is a natural number) is called Taj.

The opposing electric potential changes when the write-in period Ta1 is complete, so as to have an electric potential difference from the electric power source electric potential on an order so that the light emitting element 704 will emit light. A display period Ts1 thus begins. Note that the display period of the first subframe period SF1 is called Ts1. In general, a display period of the j-th sub-frame period SFj (where j is a natural number) is denoted by using a reference symbol Tsj. The light emitting elements 704 of each pixel are placed in a light emitting state or a non-light emitting state, corresponding to the input signal, in the display period Ts1.

The above operations are repeated for all of the subframe periods SF1 to SF4, one frame period F1 is completed. The length of the display periods Ts1 to Ts4 of the subframe periods SF1 to SF4 are set appropriately here, and gradations are expressed by an accumulation of the display periods of the subframe period during which the light emitting elements 804 emit light. In other words, the total amount of the turn on time within one frame period is used to express the gradations.

A method of generally expressing $2^n$ gradations by inputting an n-bit digital video signal, is explained. One frame period is divided into n sub-frame periods SF1 to SFn at this point, for example, and the ratios of the lengths of the display periods Ts1 to Tsn of the sub-frame periods SF1 to SFn are set so as to be Ts1::Ts2:: . . . ::Tsn−1:: Tsn=$2^0$::$2^{-1}$:: . . . ::$2^{-n+2}$::$2^{-n+1}$. Note that the lengths of the write-in periods Ta1 to Tan are all the same.

Within one frame period, the gradation of the pixels in the frame period is determined by finding the total of the display period Ts during which a light emitting state is selected in the light emitting elements 704. For example, if the brightness for a case in which a pixel emits light during all of the display periods is taken to be 100% when n=8, then a brightness of 1% can be expressed if the pixel emits light in the display period Ts8 and in the display period Ts7. A 60% brightness can be expressed for cases in which the pixel emits light in the display periods Ts6, Ts4, and Ts1.

It is preferable that the display device has as little electric power consumption as possible here. Low electric power consumption is especially desirable if the display device is incorporated into a portable information device or the like to be utilized.

In this case, with respect to a display device, into which the 4-bit signal mentioned above is input to thereby display $2^4$ gradations, gradations are expressed by using only the tipper order 1-bit signal (digital signal), a method of reducing the electric power consumption of the display device is used.

A timing chart showing a driving method of the display device in a display mode of this case is shown in FIG. 9. Signals are input to respective pixels in the first sub-frame period SF1. When the signals are input to all of the pixels, the opposing electric potential changes to have an electric potential difference from the electric power source electric potential so that the light emitting elements emit light. The light emitting elements of all of the pixels are thus placed in a light emitting state or a non-light emitting state. Operations in the first sub-frame period are the same as the operations performed in the above mentioned display mode.

Next, the digital image signal is also similarly written to all of the pixels in the write-in period of the second sub-frame period. However, in the following display period, the electric potential of the opposing electrode does not change so as to have an electric potential difference from the electric power source electric potential so that the light emitting element emit light. That is, the light emitting elements of the pixels do not emit light in the display period of the second sub-frame period, regardless of the signals input to the pixels. This period is denoted as non-display.

Operations in the second sub-frame period are similarly repeated in the third sub-frame period and in the fourth sub-frame period to thus complete one frame period. The period in which the pixels perform display during one frame period is only the first sub-frame period. The number of times that the light emitting elements of the pixels emit light can thus be lowered, and the electric power consumption of the display device can be reduced.

However, in such a display device, each pixel of the display device does not perform display in a period except a sub-frame period which is corresponding to an upper bit for expressing gradations without using information of lower bits, in each driver circuit (source signal line driver circuit and gate signal line driver circuit), write-in operation of the digital video signal to each pixel is performed. At this time, start pulses, clock pulses and the like are input to each driver circuit of the display device to thereby continue the operation.

Therefore, even gradation display is performed with a small amount of information, each-of the driver circuits repeatedly performs sampling of the digital image signal, which is the same as sampling operations in the first display mode. Electric power is therefore consumed for sampling, and there is a problem that the electric power consumption cannot be made smaller.

Furthermore, in the sub-frame periods except the sub-frame period during which display is actually performed, the pixels are all uniformly in a non-display state during which light is not emitted. There is therefore a problem that the proportion of the effective display period in one frame period is small.

SUMMARY OF THE INVENTION

An object of the present invention is to provide a display device in which electric power consumption is small and in which the proportion that an effective display period occupies per one frame period is large, in the case of performing drive in which the number of gradations expressed is reduced.

The display device of the present invention has a first display mode capable of expressing high-level gradations and a second display mode capable of expressing two gradations with low power consumption, and these 2 modes can be switched mutually and used. Write-in of the lower order bits of a digital video signal to a memory is eliminated by a memory controller of a signal control circuit in a display device during a second display mode as compared to a first display mode. Further, readout of the lower order bits of the digital video signal from the memory is also eliminated. Each driver circuit thus inputs a digital image signal with a reduced amount of information to a source signal line driver circuit in comparison to a digital image signal in the first display mode. Corresponding to this operation, a display controller functions to produce start pulses and clock pulses each with a lower frequency which are input to each of the driver circuits (the source signal line driver circuit and a gate signal line driver circuit). Write-in periods and display periods of the sub-frame periods participating in display can thus be set longer.

Also, the display periods can be set longer without changing the frequencies of the start pulses and clock pulses. Further, one frame period per se can be set longer in the second display mode in comparison to that in the first display mode. And, needless to say that the start pluses and clock pluses can be stopped when the contents of display are defined and there is no necessary to write-in.

A display device in which electric power consumption is small and in which the proportion that an effective display period occupies is large, can thus be provided in accordance with the above structure.

BRIEF DESCRIPTION OF THE DRAWINGS

In the accompanying drawings:

FIGS. 14A to 14F show examples of electronic appliances using the display device of the present invention;

DETAILED DESCRIPTION OF THE PREFERRED EMBODIMENTS

An embodiment mode of the present invention is explained. Here, similar to the conventional examples, an example of the first display mode will be described with 4-bit.

A timing chart for a method of driving a display device of the present invention is shown in FIG. 1.

In general, a display device into which an n bit digital video signal (where n is a natural number) is input, it is possible to express $2^n$ gradations by using n sub-frame periods SF1 to SFn and the n bit digital image signal in the first display mode, it can also be applied to express 2 gradations by using 1-bit digital image signal in the second display mode in accordance with switch-over operation.

Further, a display device into which n bit digital video signal is input (where n is a natural number), in the first display mode, the n bit digital image signal is input, and it is possible to express w gradations (where w is a natural number) using r sub-frame periods (where r is a natural number), it can also be applied to express 2 gradations by using 1-bit digital image signal in the second display mode in accordance with switch-over operation. Here the reason why the number of gradations not being set to power of 2 of subframes is to take a measure for a pseudo contour on display. Details are described in Japanese Patent Application No. 2001-257163.

Figure 1A:
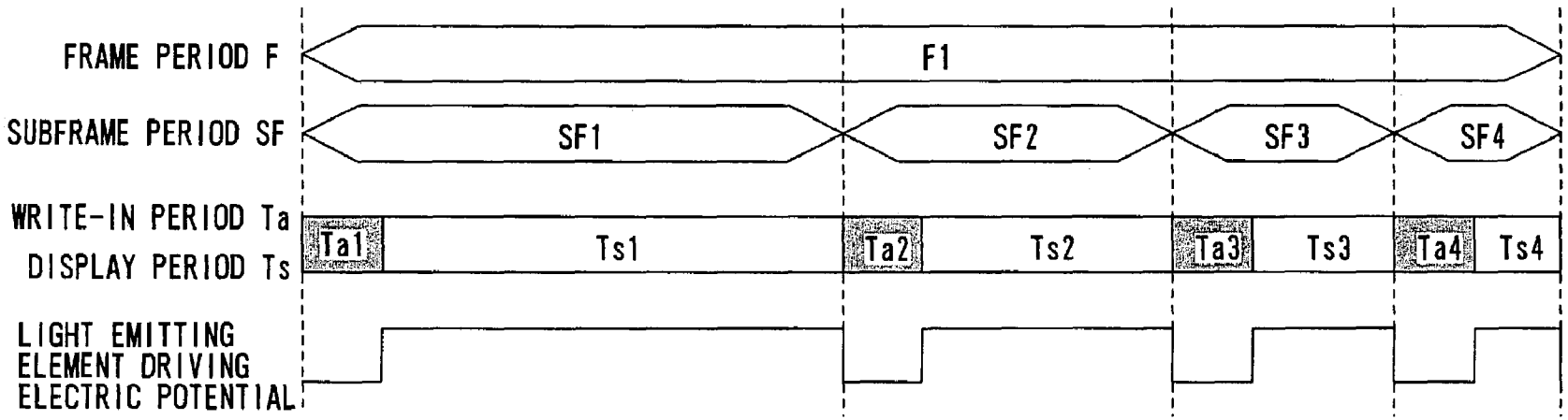
FIGS. 1A and 1B are timing charts showing a method of driving a display device according to the present invention.

A timing chart in a case of the first display mode, in which the 4-bit signal is input and $2^4$ gradations are expressed, is shown in FIG. 1A.

Each pixel is selected to be in a light emitting state or in a non-light emitting state in a display period in each of sub-frame periods SF1 to SF4 structuring one frame period. An opposing electric potential is set to be nearly the same as an electric power source electric potential during write-in periods, and is changed in the display periods so as to have an electric potential difference from the electric power source electric potential to an extent that light emitting elements will emit light. These operations are similar to the conventional example, and a detailed explanation is therefore omitted.

Figure 1B:
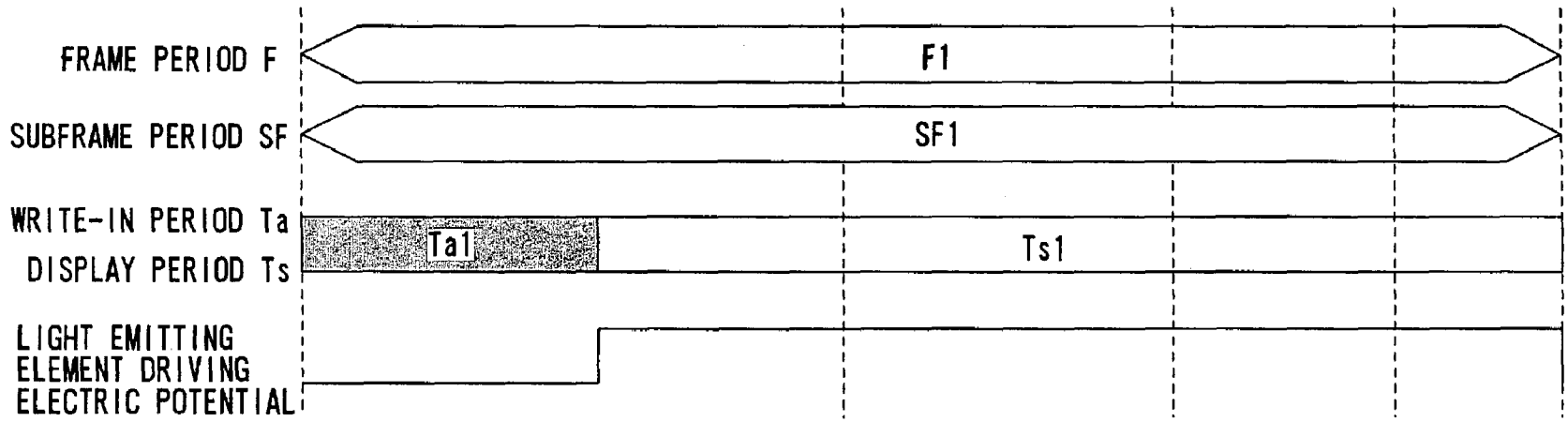

A timing chart in a case of the second display mode for expressing gradations using only the upper order one bit signal is shown in FIG. 1B. Compared to the first display mode shown in FIG. 1A, the write-in period and the display period are set longer.

Therefore, in the second display mode, the brightness of the light emitting element selected to be in a light emitting state can be made smaller compared to the brightness of the light emitting element selected to be in a light emitting state in the display period of the sub-frame period corresponding to the upper order bit in the first display mode. Consequently, the voltage applied between an anode and a cathode of the light emitting element can be set lower in the display periods with the second display mode.

Figure 13A:
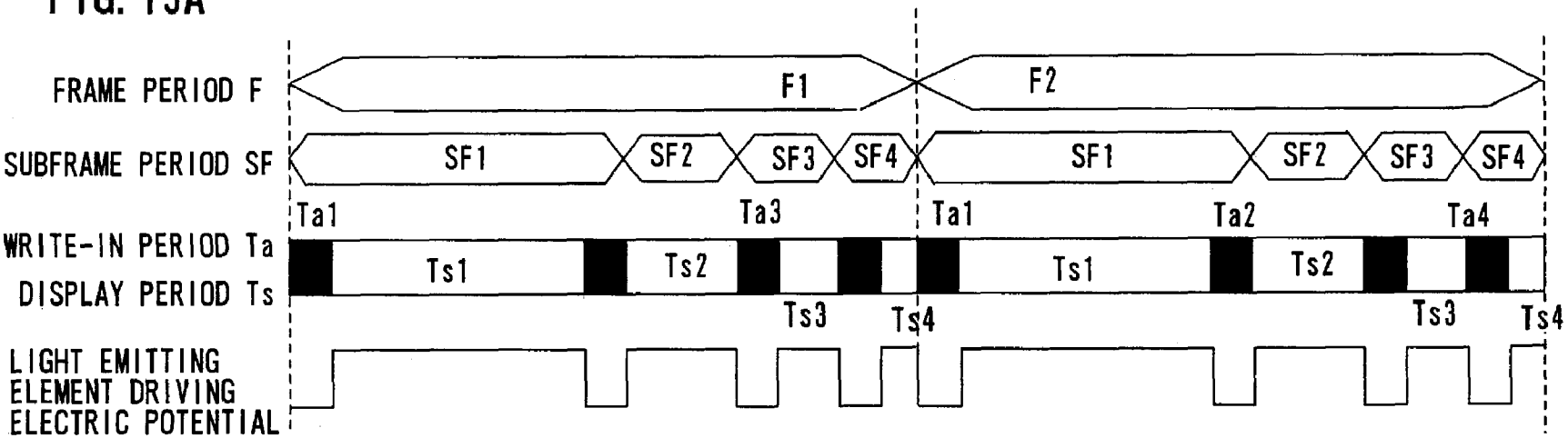
FIGS. 13A and 13B are timing charts showing a method of driving the display device according to the present invention.
Figure 13B:
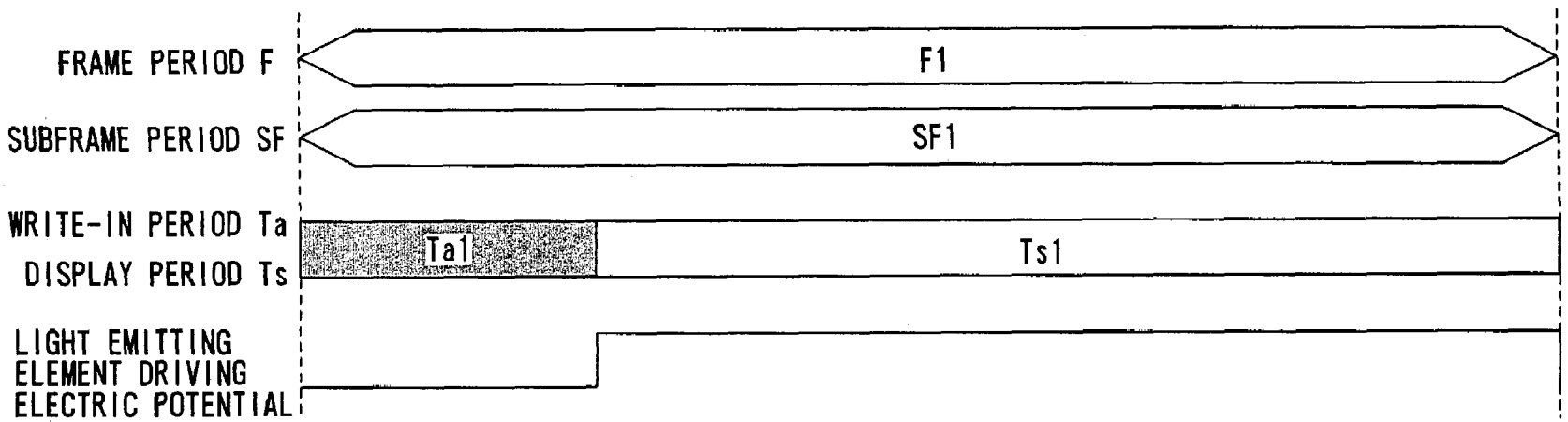

Further, FIG. 13 shows an example in which the frame period of the second display mode is set to be longer than that of the first display mode. A long frame period is impossible to be set when a time gradation is used. If the frame period is set longer, the subframe period in proportion thereto will also become longer, flickers will thus be recognized. Accordingly, the frame period of the first display mode cannot be set longer. However, since the second display mode is 2 gradations, problems of flickers caused by the gradation will not occur. Accordingly, the frame period is determined by a retention time in the pixel. Therefor, the frame period can be set longer by enlarging capacities of pixel, reducing leaks and the like. When the frame period becomes longer, since the number of writing-ins to the screen can be reduced, thus, low power consumption can be improved.

Figure 3:
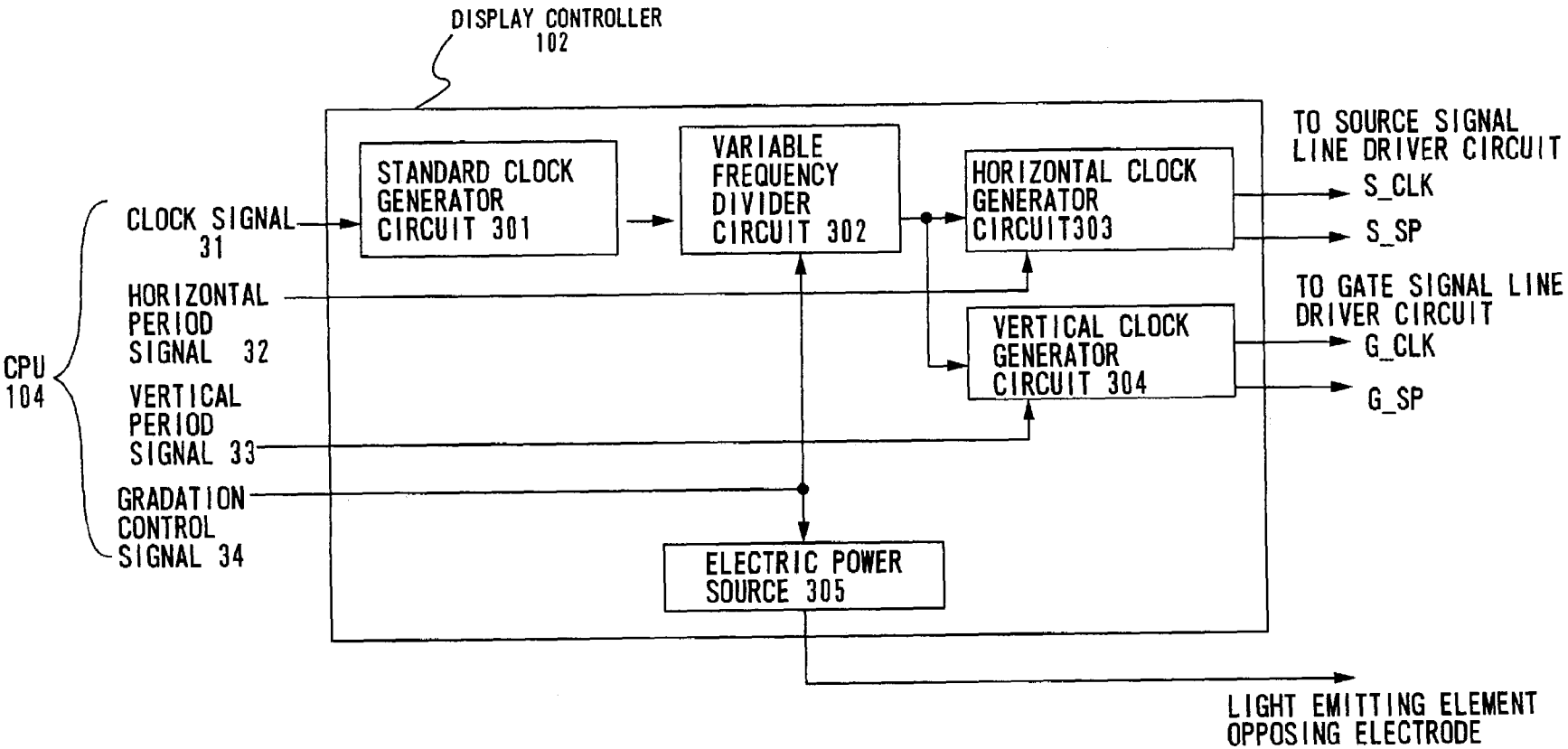
FIG. 3 shows a configuration of a display controller of the display device according to the present invention.

During the write-in period, the electric power source control circuit 305 in FIG. 3 used for the light emitting element maintains the electric potential of the opposing electrode (opposing electric potential) of the light emitting element at an electric potential which is nearly the same as the electric power source electric potential. In the display period, the electric potential of the opposing electrode of the light emitting element is controlled so as to have an electric potential difference from the electric power source electric potential to an extent that the light emitting element will emit light. The gradation control signal 34 is also input to the electric power source control circuit 305 here. The electric potential of the opposing electrode of the light emitting element is thus changed in order that the voltage applied between both electrodes of the light emitting element becomes smaller by an amount that the light emitting period for the light emitting element becomes longer.

The voltage applied between both the electrodes of the light emitting element can be made smaller in the second display mode, and therefore stress on the light emitting element due to the applied voltage can also be made smaller.

Note that although the display device shown is one which switches between the first display mode and the second display mode, the present invention can also be applied to a case in which, in addition to the first display mode and the second display mode, at least one more mode in which the number of gradations expressed is changed are additionally established, and display is performed by switching between the plurality of modes.

Figure 7:
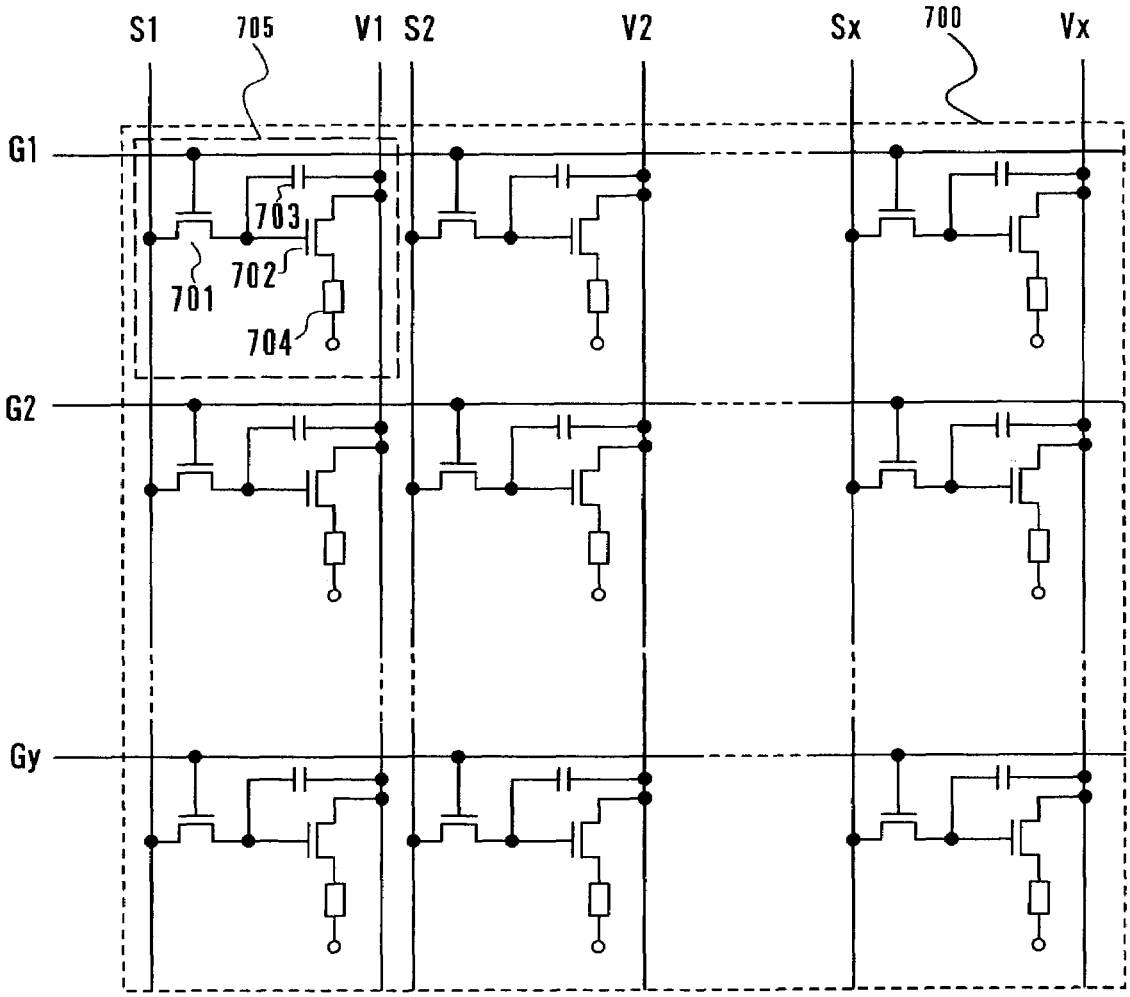
FIG. 7 shows a structure of a pixel portion of the display device.

Pixels with the structure shown in FIG. 7 in the conventional example can be used here to structure the pixel portion of the display of the display device according to the present invention. Further, pixels with another known structure can also be freely used.

Furthermore, circuits with known structures can be freely used for the source signal line driver circuit and the gate signal line driver circuit of the display of the display device according to the present invention.

In addition, it is also possible to apply the present invention not only to a display device using OLED elements, but also to self-light emitting type display devices using FDPs, PDPs, and the like as light emitting elements.

EMBODIMENTS

Hereafter, embodiments of the present invention will be described.

Embodiment 1

Figure 6:
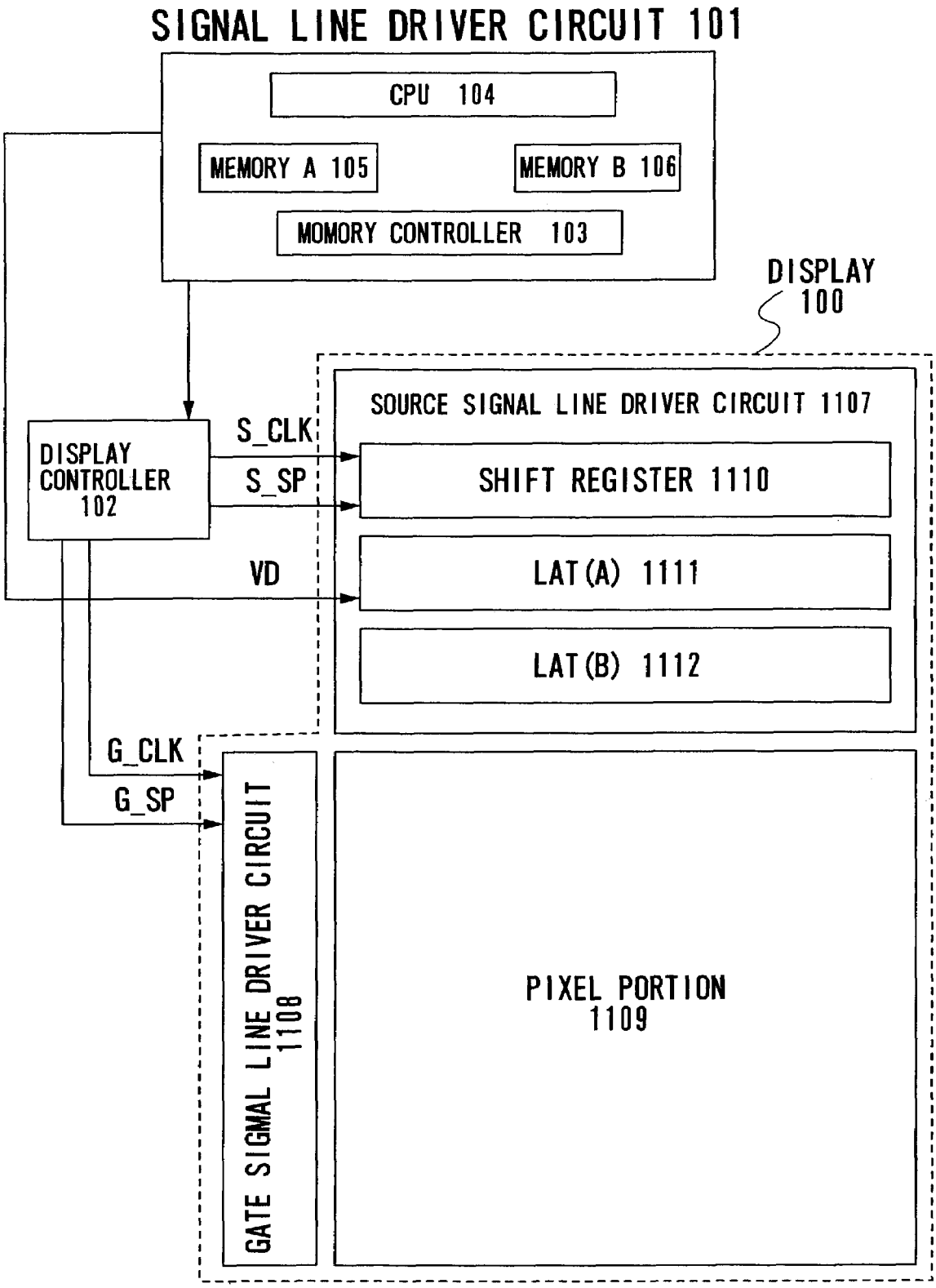
FIG. 6 is a block diagram showing a configuration of the display device of the present invention.

A circuit for inputting a signal in order to perform a time gradation driving method to the source signal line driver circuit and the gate signal line driver circuit of the display is explained using FIG. 6.

Image signals input to the display device are referred to as digital video signals within this specification. Note that the example explained here is that of a display device into which a 4-bit digital video signal is input. However, the present invention is not limited to 4-bit.

The digital video signal is read in by the signal control circuit 101, and a digital image signal (VD) is output to the display 100.

A signal converted for input to the display in the signal control circuit, the edited digital video signal, is referred to as the digital image signal within this specification.

Signals for driving the source signal line driver circuit 1107 and the gate signal line driver circuit 1108 of the display 100 are input from the display controller 102.

The structure of the signal control circuit 101 and the structure of the display controller 102 will be explained.

Note that the source signal line driver circuit 1107 of the display 100 is constituted by a shift register 1110, an LAT (A) 1111, and an LAT (B) 1112. In addition, although not shown in the figures, circuits such as level shifters and buffers may also be formed. In addition, the present invention is not limited to such a structure.

The signal control circuit 101 is constituted by a CPU 104, a memory A 105, a memory B 106, and a memory controller 103.

The digital video signal input to the signal control circuit 101 is input to the memory A 105 through the memory controller 103. The memory A 105 has a capacity that is capable of storing the 4-bit digital signal for all pixels of the pixel portion 1109 of the display 100. When one frame period portion of the signal is stored in the memory A 105, the signal for each bit is readout in order by the memory controller 103, and then is input to the source signal line driver circuit as the digital image signal VD.

The digital video signal corresponding to the next frame period is then input to the memory B 106, through the memory controller 103, when readout of the digital signals stored in the memory A 105 begins, and storage of the digital video signal in the memory B begins. Similarly to the memory A 105, the memory B 106 also has a capacity that is capable of storing the 4-bit digital signal for all pixels of the pixel portion of the display device.

The signal control circuit 101 thus has the memory A 105 and the memory B 106, each of which is capable of storing one frame period portion of the 4-bit digital signal. The digital video signal is sampled using the memory A 105 and the memory B 106 alternately.

The signal control circuit 101 for storing signals by using the two memories alternately, namely the memory A 105 and the memory B 106, is shown here. In general, however, memories capable of storing information corresponding to a plurality of frame portions are used. These memories can be used alternately.

Figure 2:
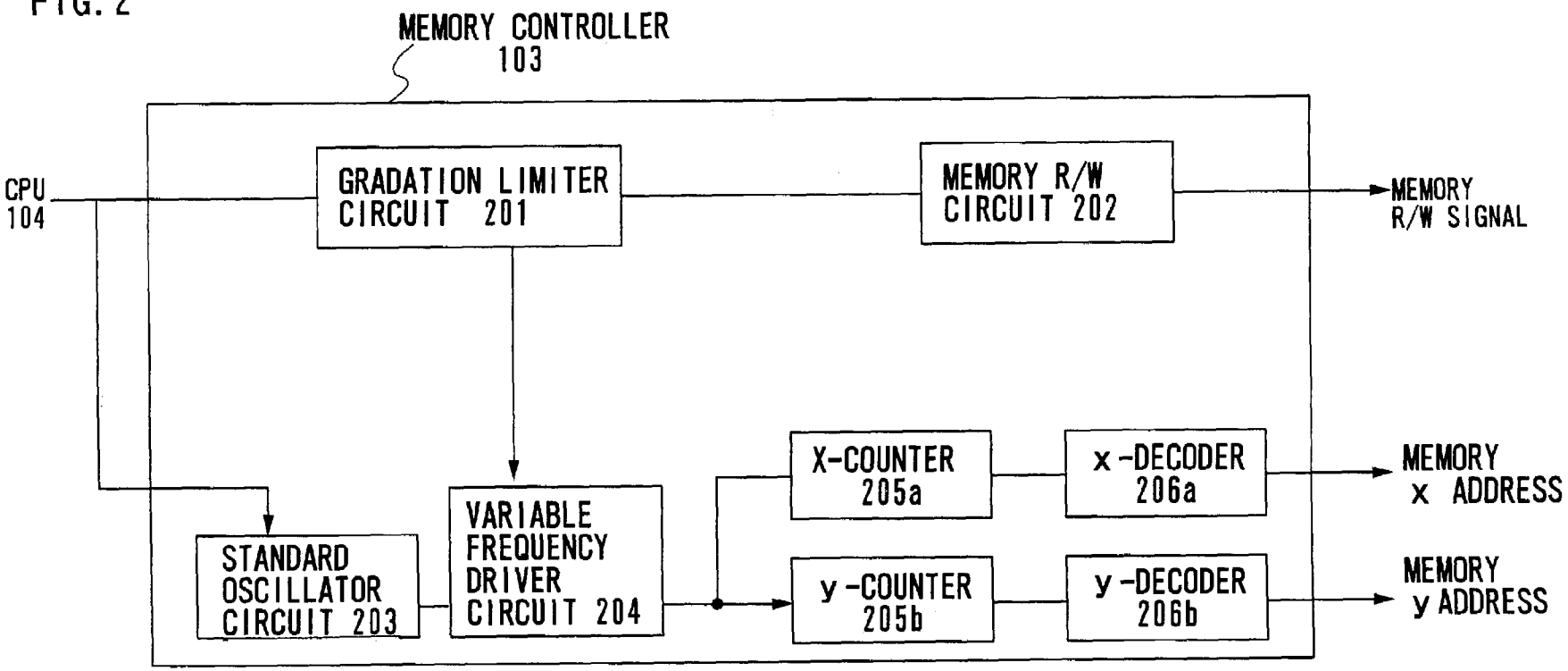
FIG. 2 shows a configuration of a memory controller of the display device according to the present invention.

The structure of the memory controller 103, used for controlling input and output of the digital video signal for the memory A 105 and the memory B 106 of the signal control circuit 101, is explained using FIG. 2.

Figure 4:
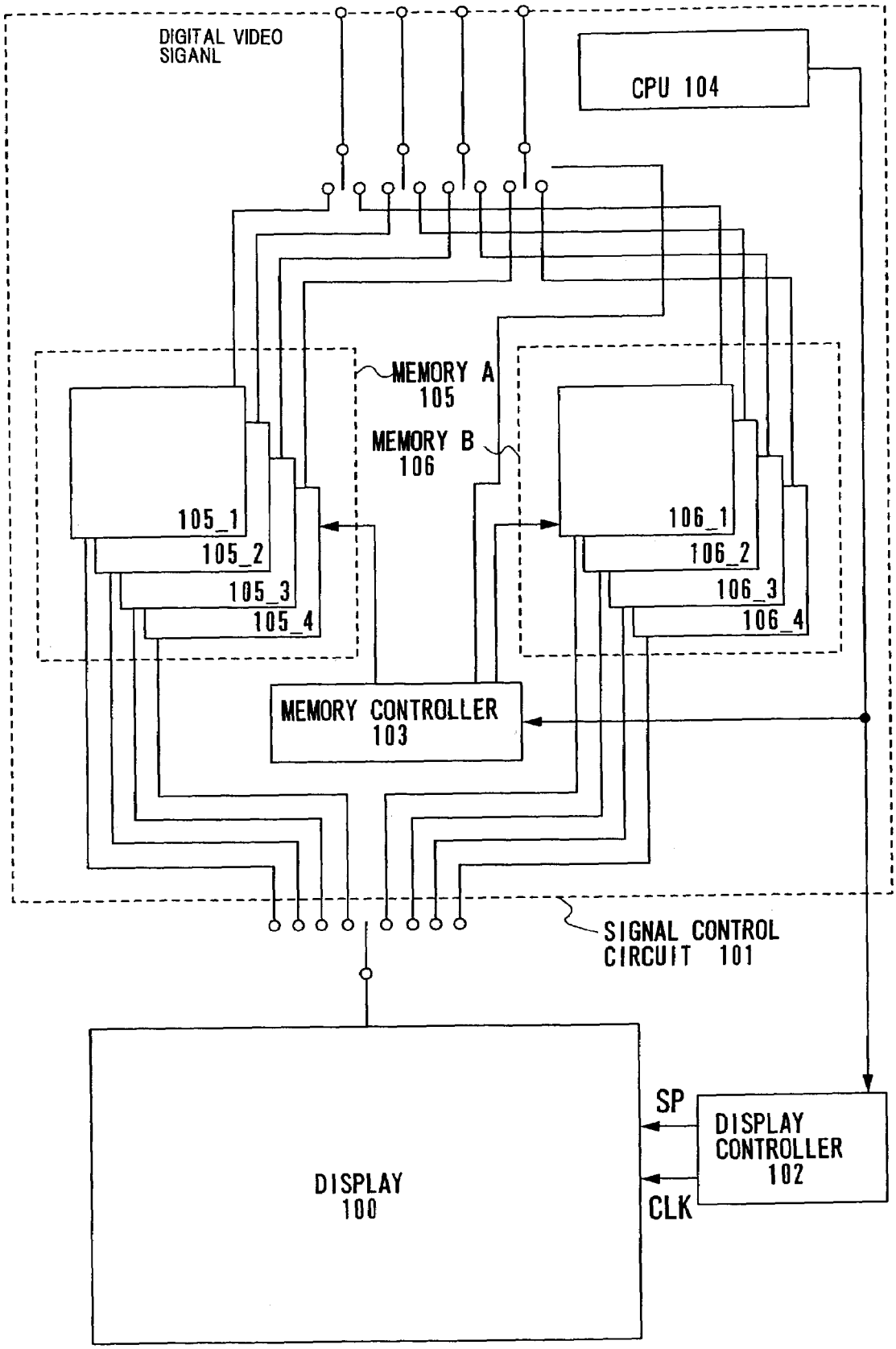
FIG. 4 is a block diagram showing a configuration of the display device of the present invention.
Figure 5A:
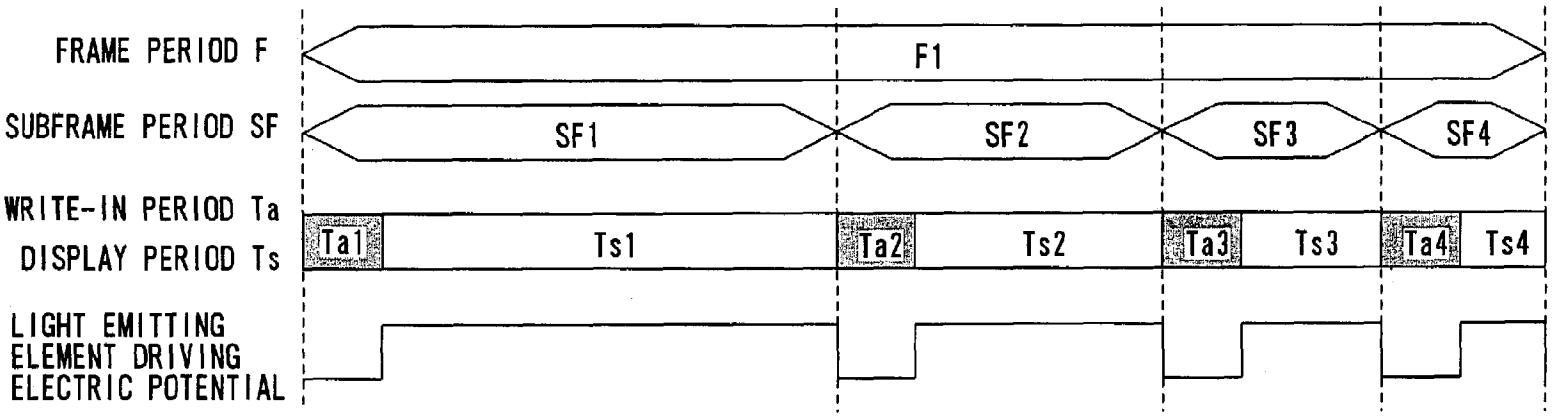
FIGS. 5A and 5B are timing charts showing a time gradation driving method.
Figure 5B:
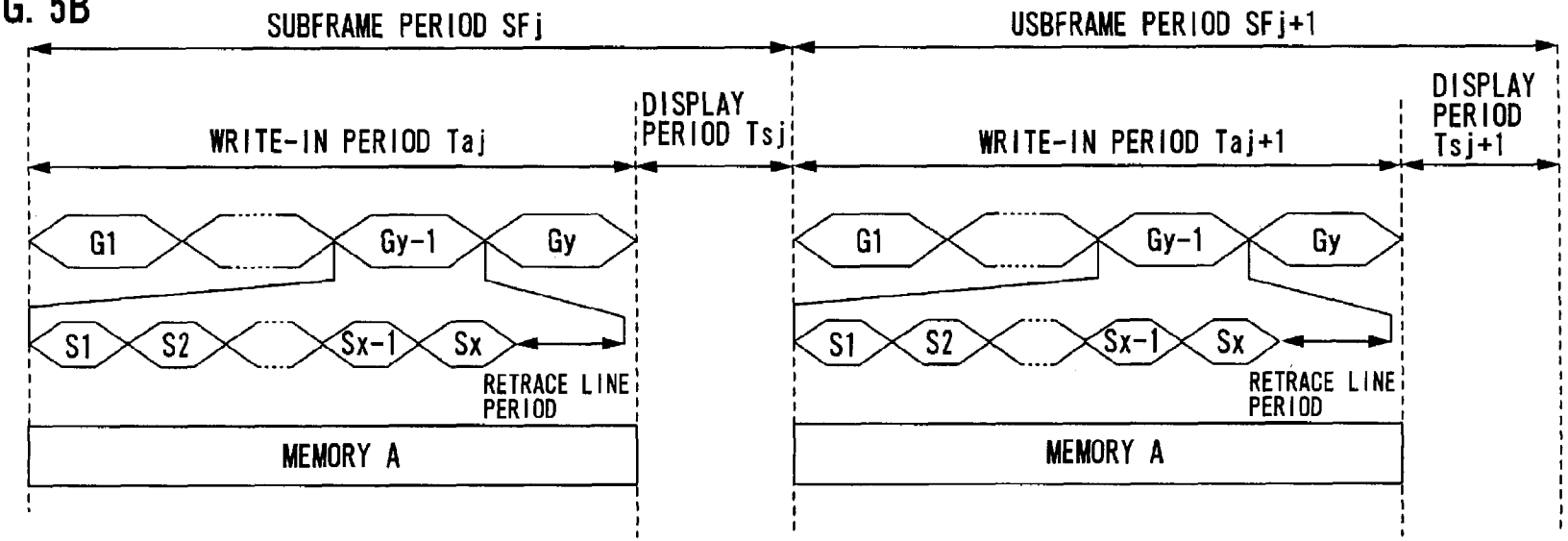

A block diagram of the display device for performing the above operations is shown in FIG. 4.

The display device is constituted by a signal control circuit 101, a display controller 102, and a display 100.

The display controller 102 supplies a start pulse SP and a clock pulse CLK to the display 100.

The signal control circuit 101 is constituted by a CPU 104, a memory A 105, a memory B 106, and a memory controller 103.

An example of a display device is shown in FIG. 4 into which the 4-bit digital video signal is input, and which expresses gradations using the 4-bit digital image signal in the first display mode. The memory A 105 is constituted by memories 105_1 to 105_4 for storing a first bit to a fourth bit, respectively, of the digital video signal. Similarly, the memory B 106 is constituted by memories 106_1 to 106_4 for storing a first bit to a fourth bit, respectively, of the digital video signal. The memories corresponding to each bit of the digital signal each have a plurality of memory elements capable of storing one bit of the signal as many as the number of pixels structuring one screen.

In general, the memory A is constituted by memories 105_1 to 105_n for storing a first bit to a n-th bit of information, respectively, in a display device which is capable of expressing gradations by using an n bit digital image signal. Similarly, the memory B is constituted by memories 106_1 to 106_n for storing the first bit to the n-th bit of information, respectively. The memories corresponding to each bit of information each have a capacity that is capable of storing one bit of the signal as many as the number of pixels structuring one screen.

The structure of the memory controller 103 is shown in FIG. 2.

The memory controller 103 is constituted by a gradation limiter circuit 201, a memory R/W circuit 202, a standard oscillator circuit 203, a variable frequency divider circuit 204, an x-counter 205*a*, a y-counter 205*b*, an x-decoder 206*a*, and a y-decoder 206*b* in FIG. 2.

The above-described memory A and the memory B are both taken together and denoted as memory. Furthermore, the memory is constituted by a plurality of memory elements. The memory elements are selected by using (x, y) addresses.

A signal from the CPU 104 is input to the memory R/W circuit 202 through the gradation limiter circuit 201. The gradation limiter circuit 201 inputs the signal to the memory R/W circuit 202 in accordance with either the first display mode or the second display mode. The memory R/W circuit 202 selects whether or not to write the digital video signal corresponding to each bit into the memory, in accordance with the signal from the gradation limiter circuit 201. Similarly, the digital image signal written into the memory is selected in readout operation.

Further, the signal from the CPU 104 is input to the standard oscillator circuit 203. A signal from the standard oscillator circuit 203 is input to the variable frequency divider circuit 204, and converted to a signal with a suitable frequency. A signal from the gradation limiter circuit 201 is input to the variable frequency divider circuit 204, in accordance with either the first display mode or the second display mode. Based on the input signal, a signal from the variable frequency divider circuit 204 selects the x-address of the memory, through the x-counter 205*a* and the x-decoder 206*a*. Similarly, a signal from the variable frequency divider circuit is input to the y-counter. 205*b* and to the y-decoder 206*b*, and selects the y-address of the memory.

The amount of information for the signal written into the memory and for the signal output from the memory, taken from the digital video signal input to the signal controller circuit, can be controlled by using memory controller 103 with the above structure in the case where high level gradation display is not necessary. Further, the frequency for reading out the signal from the memory can be changed.

Further, the structure of the display controller 102 is explained.

FIG. 3 is a diagram showing the structure of the display controller of the present invention.

The display controller 102 is constituted by a standard clock generator circuit 301, a variable frequency divider circuit 302, a horizontal clock generator circuit 303, a vertical clock generator circuit 304, and an electric power source 305 used for the light emitting elements.

A clock signal 31 input from the CPU 104 is input to the standard clock generator circuit 301, and a standard clock is generated. The standard clock is input to the horizontal clock generator circuit 303 and to the vertical clock generator circuit 304, through the variable frequency divider circuit 302. A gradation control signal 34 is input to the variable frequency divider circuit 302. The frequency of the standard clock is changed in accordance with the gradation control signal 34.

The extent that the frequency of the standard clock is changed in the variable frequency divider circuit 302 can be suitably determined by the operator.

Further, a horizontal period signal 32 which determines a horizontal period is input to the horizontal clock circuit 303 from the CPU 104, and the clock pulse S_CLK and the start pulse S_SP for the source signal line driver circuit are output. Similarly, a vertical period signal 33 which determines a vertical period is input to the vertical clock circuit 304 from the CPU 104, and the clock pulse G_CLK and the start pulse G_SP for the gate signal line driver circuit are output.

Readout of the lower order bits of the signal from the memory is thus eliminated in the memory controller of the signal controller circuit. Further, the frequency for reading out signals from the memory is made smaller. Corresponding to these operations, the display controller lowers the frequency of the sampling pulse SP and the frequency of the clock pulse CLK input to each of the driver circuits (the source signal line driver circuit and the gate signal line driver circuit), and lengthens the write-in period and the display period of the sub-frame period for expressing the image.

For example, one frame period is divided into four sub-frame periods in the first display mode. With that the ratio of the display periods Ts1, Ts2, Ts3, and Ts4 of the respective sub-frame periods set to be $2^0:2^{-1}:2^{-2}:2^{-3}$, a display device for expressing $2^4$ gradations using a 4-bit digital image signal is considered. For simplicity, the lengths of the display periods Ts1 to Ts4 of each sub-frame period are taken to be 8, 4, 2, and 1, respectively. Further, the lengths of the write-in periods Ta1 to Ta4 of each sub-frame period are taken to be 1. Furthermore, a case of expressing gradations using the upper order bit of the signal in the second display mode is considered.

The occupied proportion per one frame period by the sub-frame period in the first display mode, that corresponds to the bit participating in gradation expression in the second display mode, becomes 9/19.

Figure 9:
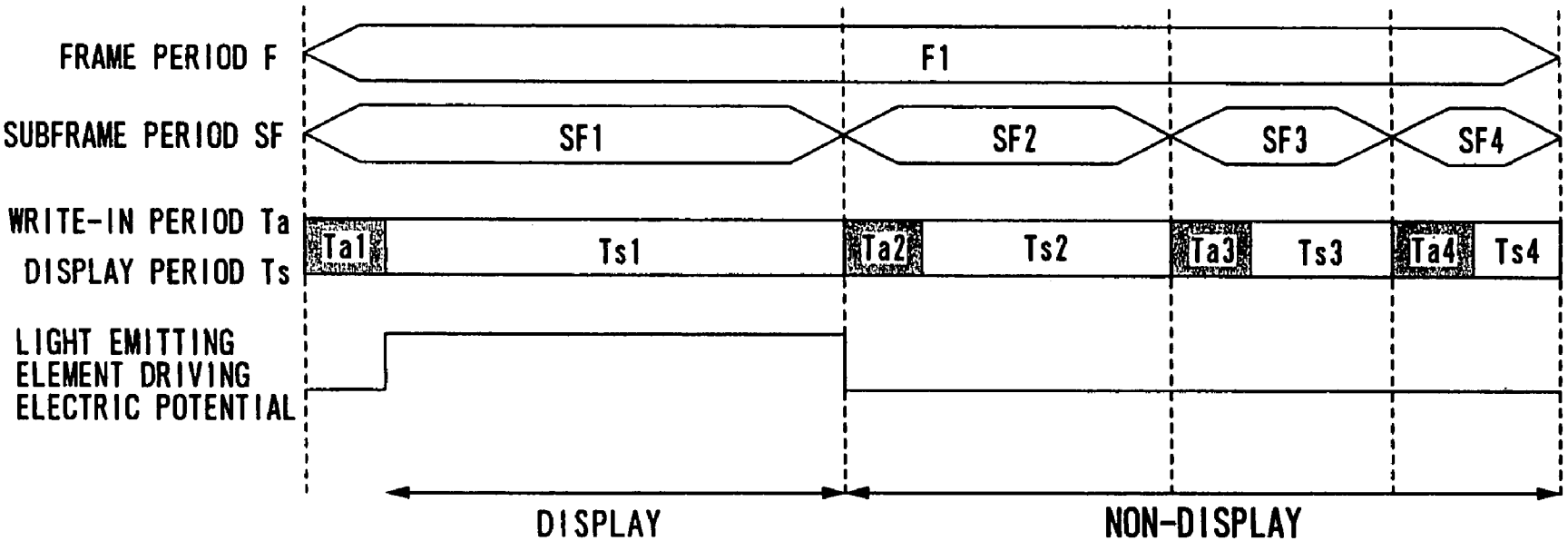
FIG. 9 (PRIOR ART)
FIG. 9 is a timing chart showing a method of driving a conventional display device.

If the structure of the present invention is not used, for example, as a case of using the conventional driving method shown in FIG. 9, 10/19 of one frame period becomes the period which is not participating in display.

On the other hand, in accordance with the structure of the present invention, the frequency of the clock signal or the like input to each driver circuit of the display is changed in the second display mode, and the write-in period is set to have a length that is 19/9 times the length of the write-in period in the first display mode. Similarly, the display period is also set to have a length that is 19/9 times the length of the display period Ts1 of the sub-frame period SF1 which is corresponding to the upper order bit in the first display mode. The sub-frame period Sf1 can thus be made to occupy one frame period. The periods which do not participate in display during one frame period can thus be reduced in the second display mode.

The display period per one frame period of the light emitting element can thus also be made increased in the second display mode.

The above-mentioned signal controlling circuit 101, memory controller 103, CPU 104, memories 105, 106, and display controller 102 may be integrally formed on the same substrate with the display 100, or may be formed by LSI chips and then be attached to the display 100 by COGs, or may be attached to the substrate by using TABs, or even, may be formed on another substrate different from that of the display and connected thereafter to the display by using electric wirings.

Embodiment 2

This embodiment shows an example of a source signal line driving circuit in a display device of the present invention is applied. An example of structure for the source signal line driving circuit is described with reference to FIG. 15.

Figure 15:
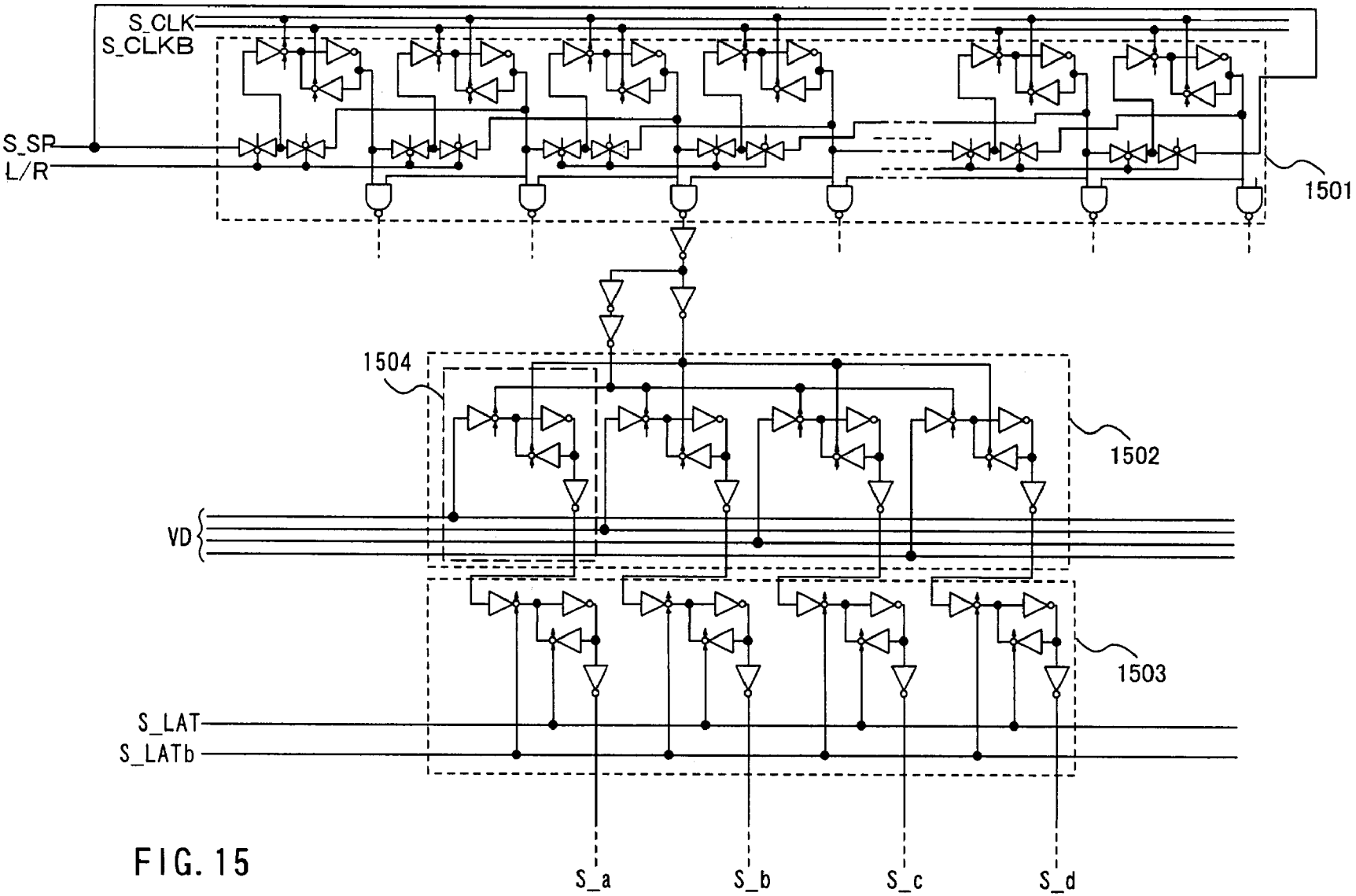
FIG. 15 shows a structure of a source signal line drive circuit of the display device of the present invention.

The source signal line driver circuit is constituted by a shift register 1501, a scanning direction switching circuit, an LAT (A) 1502 and an LAT (B) 1503. Note that, although only a part of the LAT (A) 1502 and a part of LAT (B) which are corresponding to one of outputs from the shift register 1501 are shown in FIG. 15, the LAT (A) 1502 and the LAT (B) 1503 correspond to all of the outputs from the shift register using a similar structure.

A shift register 1501 is constituted by clocked inverters, an inverter, and a NAND. A start pulse S_SP for the source signal line driver circuit is input to the shift register 1501. By changing the state of the clocked inverters between a conductive state and a non-conductive state in accordance with a clock pulse S_CLK for the source signal line driver circuit and an inverted clock pulse S_CLKB for the source signal line driver circuit which has an inverse polarity to that of the clock pulse S_CLK, sampling pulses are output in order from the NAND to the LAT (A) 1502.

Further, the scanning direction switching circuit is constituted by switches, which works to switch the operation direction of the shift register 1501 between left and right directions. In FIG. 15, the shift register 1501 outputs sampling pulses in order from the left to the right in the case in which a left and right switching signal L/R corresponds to a Lo signal. On the other hand, if the left and right switching signal L/R is a Hi signal, then sampling pulses are output in order from the right to the left.

Each stage of the LAT (A) 1502 is constituted by clocked inverters, and inverters.

The term "each stage of the LAT (A) 1502" denotes the LAT (A) 1502 for taking in an image signal input to one source signal line here.

A digital image signal VD output from the signal control circuit explained in the embodiment mode is input in p divisions (where p is a natural number) here. That is, signals corresponding to output to p source signal lines are input in parallel. If a sampling pulse is input at the same time to the clocked inverters of p stages of the LAT (A) 1502 through buffers, then the respective input signals in p divisions are sampled simultaneously in p stages of the LAT (A) 1502.

A source signal line driver circuit for outputting signal currents to x source signal lines is explained here, and therefore x/p sampling pulses are output in order from the shift register per one horizontal period. The p stages of the LAT (A) 1502 simultaneously sample the digital image signals which are corresponding to output to the p source signal lines in accordance with each sampling pulse.

A read in method, in which the digital image signals thus input to the source signal line driver circuit are divided into parallel signals of p phases and the p digital images signals are taken in by using one sampling pulse, is referred to as p-division drive in this specification. A 4-division is conducted in FIG. 15.

A margin can be given to the sampling of the shift register in the source signal line driver circuit by performing the above-stated division drive. The reliability of the display device can thus be increased.

When all of the signals for one horizontal period are input to each stage of the LAT (A) 1502, a latch pulse LP and an inverted latch pulse LPB which has a inverse polarity to the latch-pulse LP are input, and the signals input to each stage of the LAT (A) 1502 are all output simultaneously to each stage of an LAT (B) 1503.

Note that the term "each stage of the LAT (B) 1503" used here denotes an LAT (B) 1503 circuit to which the signal from each stage of the LAT (A) 1502 is input.

The LAT (B) 1503 is constituted by clocked inverters and inverters. The signals output from the LAT (A) 1502 are stored in the LAT (B) 1503 and at the same time are output to each of source signal lines S1 to Sx.

Note that, although not shown in the figures, circuits such as level shifters and buffers may also be suitably formed.

Signals such as the start pulse S_SP and the clock pulse S_CLK, input to the shift register 1501, the LAT (A) 1502, and the LAT (B) 1503, are input from the display controller shown in the embodiment mode of the present invention.

With the present invention, operations for inputting a digital image signal with a small number of bits to the LAT (A) of the source signal line driver circuit are performed by the signal controller circuit. At the same time, operations for reducing the frequency of the clock pulse S_CLK, the start pulse S_SP, and the like, input to the shift register of the source signal line driver circuit, are performed by the display controller.

Operations for sampling the digital image signal by the source signal line driver circuit can thus be reduced in the second display mode, and the electric power consumption of the display device can be curbed.

Note that the source signal line driver circuit of the display device according to the present invention is not limited to the structure of the source signal line driver circuit of Embodiment 2, and that source signal line driver circuits with known structure can also be freely used.

Embodiment 3

An example of a structure of a gate signal line driver circuit of a display device according to the present invention will be explained in Embodiment 3.

The gate signal line driver circuit is constituted by a shift register, a scanning direction switching circuit, and the like. Note that, although not shown in the figure, circuits such as level shifters and buffers may also be suitably formed.

Signals such as a start pulse G_SP and a clock pulse G_CLK are input to the shift register, and a gate signal line selection signal is output.

Figure 16:
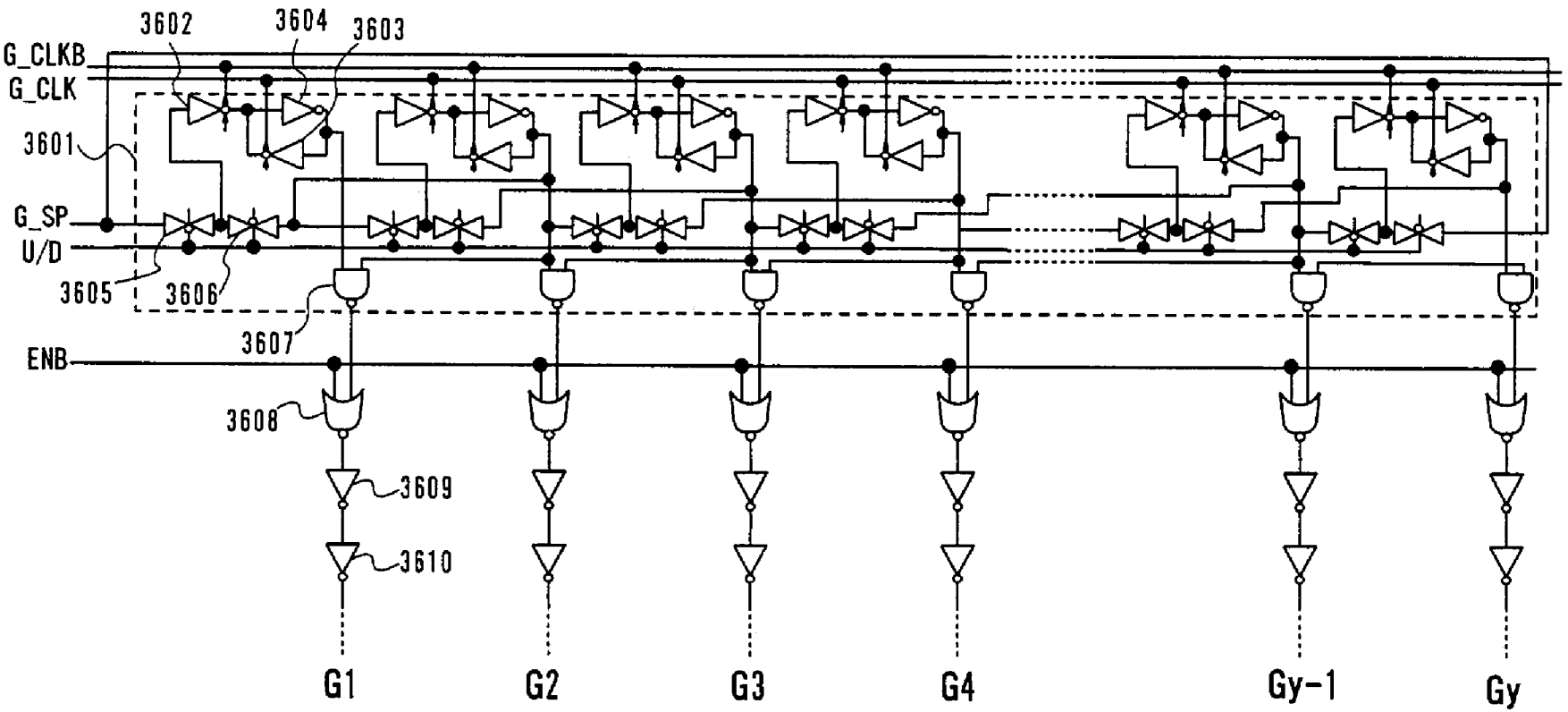
FIG. 16 shows a structure of a gate signal line drive circuit of the display device of the present invention.

The structure of the gate signal line driver circuit is explained using FIG. 16.

A shift register 3601 is constituted by clocked inverters 3602, 3603, an inverter 3604, and a NAND 3607. The start pulse G_SP is input to the shift register 3601. By changing the state of the clocked inverters 3602 and 3603 between a conductive state and a non-conductive state in accordance with a clock pulse G_CLK and an inverted clock pulse G_CLKB which has a inverse polarity to the clock pulse G_CLK, sampling pulses are output in order from the NAND 3607.

Further, the scanning direction switching circuit is constituted by a switch 3605 and a switch 3606, and functions to switch the operation direction of the shift register between left and right directions. In FIG. 16, the shift register outputs sampling pulses in order from the left to the right in the case in which a left and right switching signal U/D corresponds to a Lo signal. On the other hand, if the left and right switching signal U/D is a Hi signal, then sampling pulses are output in order from the right to the left.

The sampling pulses output from the shift register are input to a NOR 3608, and operation is performed with an enable signal ENB. This operation is performed in order to prevent a condition in which adjacent gate signal lines are selected at the same time due to dull sampling pulses. The signals output from the NOR 3608 are output to gate signal lines G1 to Gy, through buffers 3609 and 3610.

Note that, although not shown in the figure, level shifters and buffers may also be formed as appropriate.

Signals such as the start pulse G_SP and the clock pulse G_CLK input to the shift register are input from a display controller shown in the embodiment mode.

With the present invention, operations to reduce the frequency of the clock pulse G_CLK, the start pulse G_SP, and the like, input to the shift register of the gate signal line driver circuit, are performed by the display controller in the second display mode.

Sampling operations of the gate signal line driver circuit can therefore be reduced, and the electric power consumption of the display device can thus be curbed, in the second display mode.

Note that the gate signal line driver circuit of the display device according to the present invention is not limited to the structure of the gate signal line driver circuit of Embodiment 3. Gate signal line driver circuits with known structures can be freely used.

It is possible to freely combine Embodiment 3 with Embodiment 1.

Embodiment 4

Figure 8:
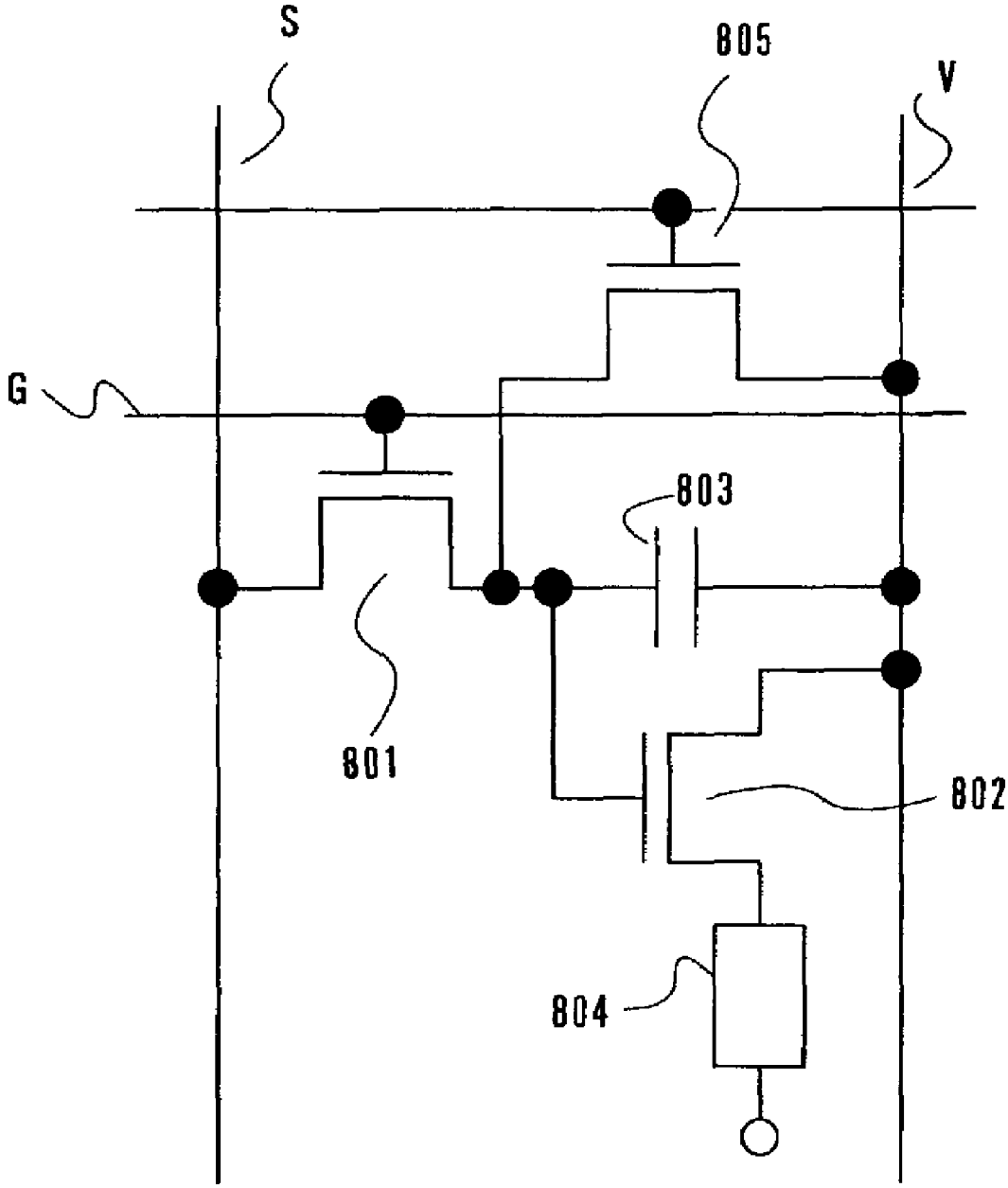
FIG. 8 shows a structure of a pixel of the display device.

In the display device using the time gradation, in addition to a method of separating between an address period and a display period, which is described above, a driving method of simultaneously conducting writing and display has been proposed. Specifically, a display device using a pixel configuration as shown in FIG. 8 is disclosed in JP 2001-343933. According to this method, in addition to a conventional switching TFT and a conventional driving TFT, an erasing TFT can be added to increase the number of gradations.

Figure 10A:
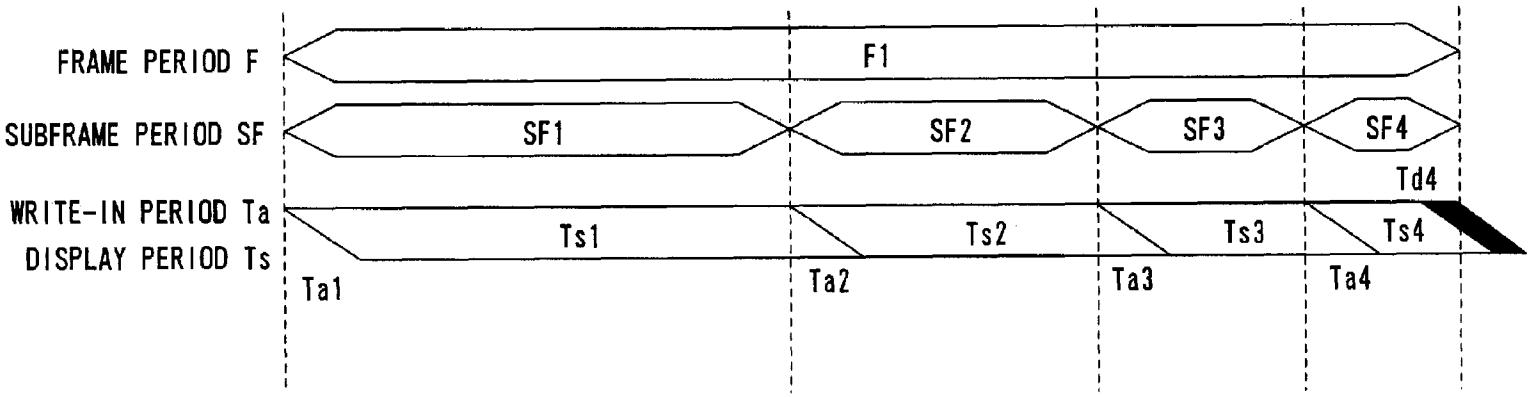
FIGS. 10A and 10B are timing charts showing a method of driving the display device according to the present invention.
Figure 10B:
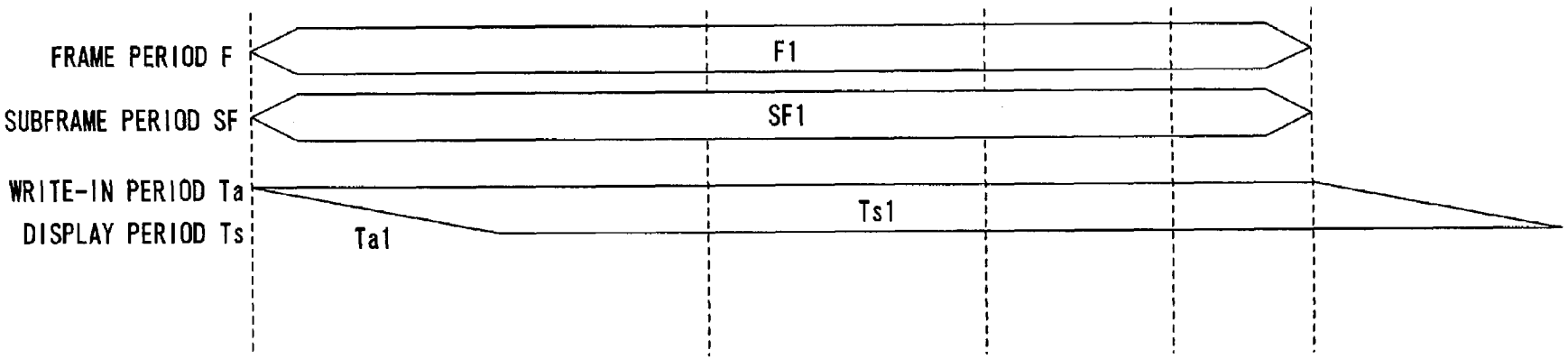

Specifically, a plurality of gate signal line drive circuits are provided, writing is conducted by a first signal line drive circuit, and erasing is conducted by a second signal line drive circuit before wiring is completed for all lines. In the case of about 4 bits, there are not much effects. However, in the case where the gradation becomes 6 bits or more or in the case where it is necessary to increase the number of subframes for a pseudo contour measure, this is a very effective measure. The present invention can be also applied to a display device using such a driving method. FIGS. 10A and 10B are timing charts in this case. In FIGS. 10A and 10B, it is used to shorten a display period at a fourth bit. This embodiment can be freely combined with Embodiments 1 to 3.

Embodiment 5

Figure 11A:
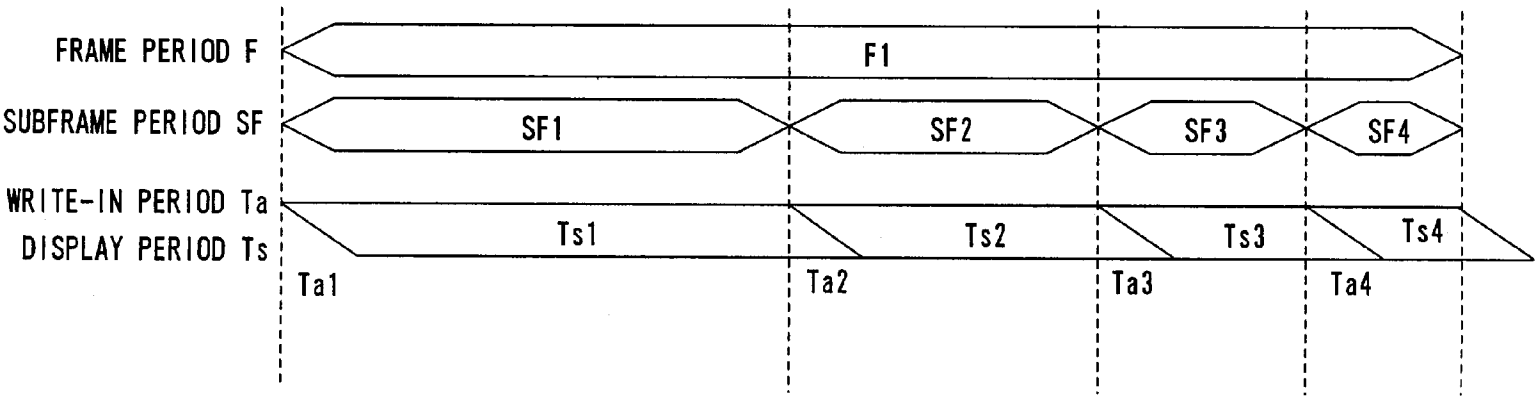
FIGS. 11A and 11B are timing charts showing a method of driving the display device according to the present invention.
Figure 11B:
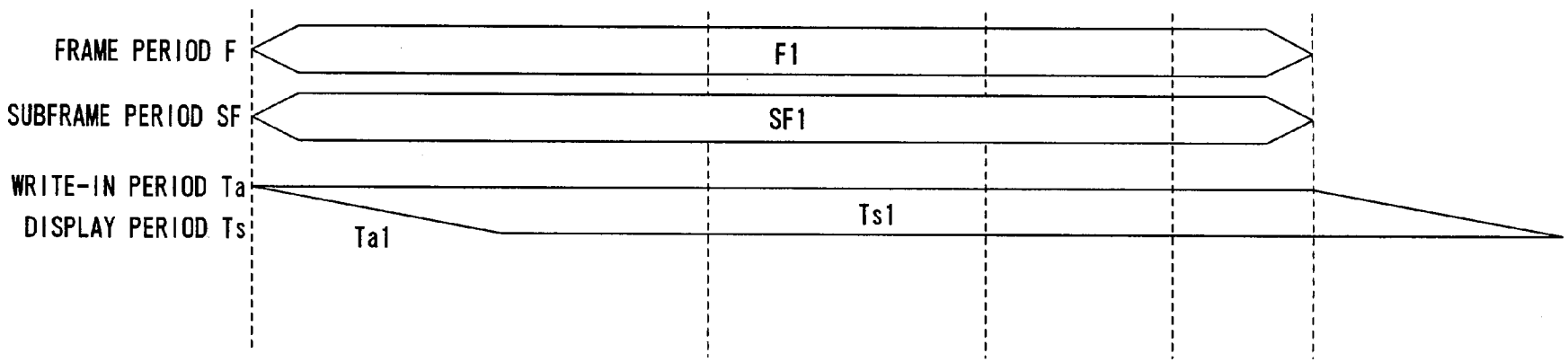

Also, a method in which the number of gradations capable of displaying is small but an address period and a display period are simultaneously conducted as in Embodiment 4 has been proposed. Timing charts in this case are shown in FIGS. 11A and 11B. A pixel configuration in this case is the same as a conventional configuration as shown in FIG. 7. There is no erasing period and a display period shorter than an address period cannot be constructed. Thus, there is a defect in that the number of gradations in a first display mode is small. However, because a circuit configuration can be simplified, it can be applied to an inexpensive edition display device. This embodiment can be freely combined with Embodiments 1 to 3.

Embodiment 6

Figure 12:
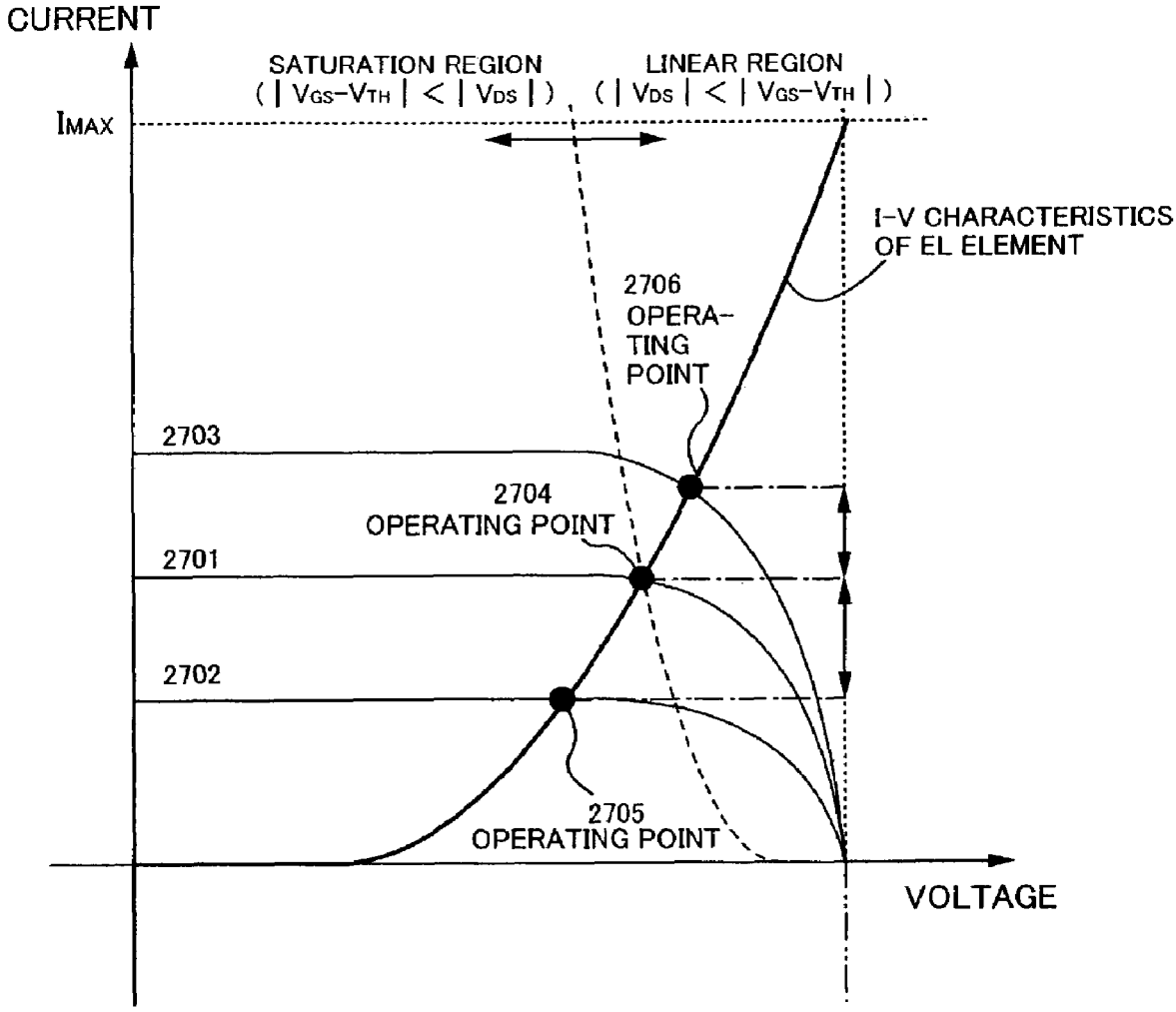
FIG. 12 shows an operating condition of a driving TFT of the present invention.

Also, according to the above method, time gradation operation is conducted by constant voltage drive. In other words, a driving TFT in a pixel is operated in a linear region. Thus, an external power source voltage is applied to a light emitting element as it is. However, there is a following defect in this method. When the light emitting element is deteriorated to change a characteristic between an applied voltage and brightness, a burn-in is caused so that display quality is deteriorated. Therefore, there is a driving method of conducting constant current drive, that is, operating a driving TFT in a pixel in a saturation region, thereby using the driving TFT as a current source. Even in this case, when an operating period of the driving TFT is controlled, time gradation is possible. This is described in Japanese Patent Application No. 2001-224422. The present invention can be applied to such constant current time gradation. FIG. 12 shows an operating point of the driving TFT. When the constant current drive is conducted, the TFT is operated in a saturation region in which an operating point 2705 is present. When the constant voltage drive is conducted, the TFT is operated in a linear region in which an operating point 2706 is present.

Embodiment 7

This embodiment describes electronic appliances which use the display device of the present invention, with reference to FIGS. 14A to 14F.

FIG. 14A is a schematic diagram of a portable information terminal according to the display device of the present invention. The portable information terminal is composed of a main body 2701*a*, operation switches 2701*b*, a power switch 2701*c*, an antenna 2701*d*, a display unit 2701*e*, and an external input port 2701*f*. The display device of the present invention is used in the display unit 2701*e*.

FIG. 14B is a schematic diagram of a personal computer according to the display device of the present invention. The personal computer is composed of a main body 2702*a*, a case 2702*b*, a display unit 2702*c*, operation switches 2702*d*, a power switch 2702*e*, and an external input port 2702*f*. The display device of the present invention is used in the display unit 2702*c*.

FIG. 14C is a schematic diagram of an image reproducing device according to the display device of the present invention. The image reproducing device is composed of a main body 2703*a*, a case 2703*b*, a recording medium 2703*c*, a display unit 2703*d*, an audio output unit 2703*e*, and operation switches 2703*f*. The display device of the present invention is used in the display unit 2703*d*.

FIG. 14D is a schematic diagram of a television according to the display device of the present invention. The television is composed of a main body 2704*a*, a case 2704*b*, a display unit 2704*c*, and operation switches 2704*d*. The display device of the present invention is used in the display unit 2704*c*.

FIG. 14E is a schematic diagram of a head mounted display according to the display device of the present invention. The head mounted display is composed of a main body 2705*a*, a monitor unit 2705*b*, a headband 2705*c*, a display unit 2705*d*, and an optical system 2705*e*. The display device of the present invention is used in the display unit 2705*d*.

FIG. 14F is a schematic diagram of a video camera according to the display device of the present invention. The video camera is composed of a main body 2706*a*, a case 2706*b*, a connection unit 2706*c*, an image receiving unit 2706*d*, an eye piece unit 2706*e*, a battery 2706*f*, an audio input unit 2706*g*, and a display unit 2706*h*. The display device of the present invention is used in the display unit 2706*h*.

No limitation is put on the above-mentioned applications of electronic appliances, the present invention can be applied to various electronic appliances.

It is possible to freely combine Embodiment 7 with Embodiment 1 to Embodiment 6.

The electric power consumption of a display device can be reduced with the aforementioned structures of the present invention. In addition, it becomes possible to lengthen the display period in one frame period. Thus, it becomes possible to provide a display device which is capable of displaying clear images.

Furthermore, the display period for a light emitting element per one frame period can be increased, and therefore the voltage applied between an anode and a cathode of the light emitting element can be set lower in the case of expressing the same brightness per frame. It thus becomes possible to provide a display device with high reliability.

It is also possible to apply the present invention to self-light emitting type display devices using FDPs, PDPs, and the like, not only to display devices using OLED elements.

What is claimed is:

1. A display device comprising:

a display having a display portion comprising a plurality of pixels; and a display controller for dividing a frame period of a first display mode into a plurality of subframe periods for which one of lighting and non-lighting is set to each of the subframe periods and expressing gradation in accordance with a total lighting time during the frame period of the first display mode, and for setting to one of lighting and non-lighting during the frame period of a second display mode, wherein the display controller can switch between the first display mode and the second display mode, wherein each of the plurality of pixels comprises at least one thin film transistor, wherein each of the plurality of subframe periods of the first display mode includes a first write-in period and a first display mode, wherein the frame period of the second display mode includes a second write-in period and a second display mode, wherein the second write-in period is longer than the first write-in period, and wherein the second display period is longer than the first display period.

2. A display device according to claim 1, wherein the display device further comprises a frame memory, n-bits data (n is natural number of two or more) is written and read out of the frame memory so that display is conducted in the frame period of the first display mode, and 1-bit data is written and read out of the frame memory so that display is conducted in the frame period of the second display mode.

3. A display device according to claim 1, wherein the display controller is integrally formed on the same substrate as the display.

4. A display device according to claim 1, wherein the display device further comprises a light emitting clement for each pixel, a specific voltage is applied to the light emitting element, and a voltage applied to the light emitting element in the frame period of the first display mode is higher than a voltage applied to the light emitting element in the frame period of the second display mode.

5. A display device according to claim 1, wherein the display device further comprises a light emitting element for each pixel, a specific current is supplied to the light emitting element, and a current supplied to the light emitting clement in the frame period of the first display mode is larger than a current supplied to the light emitting element in the frame period of the second display mode.

6. A display device according to claim 1, wherein the frame period of the first display mode is composed of three periods of a wiring period, a display period, and an erasing period.

7. A display device comprising:

a display having a display portion comprising a plurality of pixels; and a display controller for dividing a frame period of a first display mode into a plurality of subframe periods for which one of lighting and non-lighting is set to each of the subframe periods and expressing gradation in accordance with a total lighting time during the frame period of the first display mode, and for setting to one of lighting and non-lighting during the frame period of a second display mode, wherein the display controller can switch between the first display mode and the second display mode, wherein each of the plurality of pixels comprises at least one thin film transistor, and wherein the frame period is set longer in the second display mode than in the first display mode, wherein each of the plurality of subframe periods of the first display mode includes a first write-in period and a first display mode, wherein the frame period of the second display mode includes a second write-in period and a second display mode, wherein the second write-in period is longer than the first write-in period, and wherein the second display period is longer than the first display period.

8. A display device according to claim 7, wherein the display device further comprises a frame memory, n-bits data (n is natural number of two or more) is written and read out of the frame memory so that display is conducted in the frame period of the first display mode, and 1-bit data is written and read out of the frame memory so that display is conducted in the frame period of the second display mode.

9. A display device according to claim 7, wherein the display controller is integrally formed on the same substrate as the display.

10. A display device according to claim 7, wherein the display device further comprises a light emitting element for each pixel, a specific voltage is applied to the light emitting clement, and a voltage applied to the light emitting element in the frame period of the first display mode is higher than a voltage applied to the light emitting element in the frame period of the second display mode.

11. A display device according to claim 7, wherein the display device further comprises a light emitting element for each pixel, a specific current is supplied to the light emitting element, and a current supplied to the light emitting clement in the frame period of the first display mode is larger than a current supplied to the light emitting element in the frame period of the second display mode.

12. A display device according to claim 7, wherein the frame period of the first display mode is composed of three periods of a wiring period, a display period, and an erasing period.

13. An electronic appliance using the display device according to claim 7.

14. A method of driving a display device including a display having a display portion comprising a plurality of pixels, and a display controller, comprising:

dividing a frame period of a first display mode into a plurality of subframe periods for which one of lighting and non-lighting is set to each of the subframe periods and expressing gradation in accordance with a total lighting time during the frame period of the first display mode; and setting to one of lighting and non-lighting during the frame period of a second display mode, wherein the display controller can switch between the first display mode and the second display mode, wherein each of the plurality of pixels comprises at least one thin film transistor, wherein each of the plurality of subframe periods of the first display mode includes a first write-in period and a first display mode, wherein the frame period of the second display mode includes a second write-in period and a second display mode, wherein the second write-in period is longer than the first write-in period, and wherein the second display period is longer than the first display period.

15. A method of driving a display device according to claim 14, wherein the display device further comprises a frame memory, n-bits data (n is natural number of two or more) is written and read out of the frame memory to conduct display in the frame period of the first display mode, and 1-bit data is written and read out of the frame memory to conduct display in the frame period of the second display mode.

16. A method of driving a display device according to claim 14, wherein the display device further comprises a light emitting element for each pixel, a specific voltage is applied to the light emitting element, and a voltage applied to the light emitting element in the frame period of the first display mode is higher than a voltage applied to the light emitting element in the frame period of the second display mode.

17. A method of driving a display device according to claim 14, wherein the display device further comprises a light emitting element for each pixel, a specific current is supplied to the light emitting element, and a current supplied to the light emitting element in the frame period of the first display mode is larger than a current supplied to the light emitting element in the frame period of the second display mode.

18. A method of driving a display device according to claim 14, wherein the frame period of the first display mode is composed of three periods of a wiring period, a display period, and an erasing period.

19. An electronic appliance using the display device according to claim 1.

20. An electronic appliance using the display device driving method according to claim 14.

21. A method of driving a display device including a display having a display portion comprising a plurality of pixels, and a display controller, comprising:

dividing a frame period of a first display mode into a plurality of subframe periods for which one of lighting and non-lighting is set to each of the subframe periods and expressing gradation in accordance with a total lighting time during the frame period of the first display mode; and setting to one of lighting and non-lighting during the frame period of a second display mode, wherein the display controller can switch between the first display mode and the second display mode, wherein each of the plurality of pixels comprises at least one thin film transistor, wherein the frame period is set longer in the second display mode than in the first display mode, wherein each of the plurality of subframe periods of the first display mode includes a first write-in period and a first display mode, wherein the frame period of the second display mode includes a second write-in period and a second display mode, wherein the second write-in period is longer than the first write-in period, and wherein the second display period is longer than the first display period.

22. A method of driving a display device according to claim 21, wherein the display device further comprises a frame memory, n-bits data (n is natural number of two or more) is written and read out of the frame memory to conduct display in the frame period of the first display mode, and 1-bit data is written and read out of the frame memory to conduct display in the frame period of the second display mode.

23. A method of driving a display device according to claim 21, wherein the display device further comprises a light emitting element for each pixel, a specific voltage is applied to the light emitting clement, and a voltage applied to the light emitting element in the frame period of the first display mode is higher than a voltage applied to the light emitting element in the frame period of the second display mode.

24. A method of driving a display device according to claim 21, wherein the display device further comprises a light emitting element for each pixel, a specific current is supplied to the light emitting element, and a current supplied to the light emitting element in the frame period of the first display mode is larger than a current supplied to the light emitting element in the frame period of the second display mode.

25. A method of driving a display device according to claim 21, wherein the frame period of the first display mode is composed of three periods of a wiring period, a display period, and an erasing period.

26. An electronic appliance using the display device driving method according to claim 21.

* * * * *